US006014879A

United States Patent [19]

Jaekel et al.

[11] Patent Number: 6,014,879

[45] Date of Patent: Jan. 18, 2000

[54] HIGH PRESSURE HYDROFORMING PRESS

[75] Inventors: Fred G. Jaekel, Richmond Hill, Canada; Frank A. Horton, Rochester Hills, Mich.; Arthur L. Lee, Aurora, Canada

[73] Assignee: Cosma International Inc., Concord, Canada

[21] Appl. No.: 09/061,094

[22] Filed: Apr. 16, 1998

Related U.S. Application Data

[60] Provisional application No. 60/043,950, Apr. 16, 1997.

[51] Int. Cl.[7] ..... B21D 26/02; B21D 39/08

[52] U.S. Cl. ..... 72/61; 72/58; 72/62; 29/421.1

[58] Field of Search ..... 72/57, 58, 61, 72/62; 29/421.1

[56] References Cited

U.S. PATENT DOCUMENTS

| | | | |
|---|---|---|---|
| 3,335,590 | 8/1967 | Early | 72/58 |
| 3,350,905 | 11/1967 | Ogura et al. | 38/68 |
| 4,788,843 | 12/1988 | Seaman et al. | 72/58 |

FOREIGN PATENT DOCUMENTS

| | | | |
|---|---|---|---|
| 0 439 764 | 8/1991 | European Pat. Off. . | |
| 0 497 438 | 8/1992 | European Pat. Off. . | |
| 1357 | 1/1976 | Japan | 72/58 |
| 22423 | 2/1980 | Japan | 72/58 |
| 82229 | 5/1985 | Japan | 72/58 |
| 96333 | 5/1985 | Japan | 72/61 |
| 1176994 | 9/1985 | U.S.S.R. | 72/58 |
| 1433527 | 10/1988 | U.S.S.R. | 72/58 |
| 2 057 322 | 4/1981 | United Kingdom . | |

*Primary Examiner*—David Jones
*Attorney, Agent, or Firm*—Pillsbury Madison & Sutro LLP

[57] ABSTRACT

An apparatus for hydroforming a tubular metal blank comprises a die structure, a hydroforming fluid source, a hydraulically driven tube-end engaging structure, a hydraulically driven pressure intensifying structure, and a single hydraulic power source. The tube-end engaging structure seals opposite ends of the tubular metal blank in said die cavity and is movable to longitudinally compress the tubular metal blank. The tube-end engaging structure receives hydroforming fluid from said hydroforming fluid source and has a hydroforming fluid supplying outlet through which hydroforming fluid can be provided to the tubular metal blank. The hydraulically driven pressure intensifying structure is movable to pressurize the hydroforming fluid provided to the interior of the tubular metal blank and thereby expand a diameter of the blank. A single hydraulic power source provides the hydraulic fluid under pressure to said hydraulically driven pressure intensifying structure in order to move the pressure intensifying structure and thereby pressurize the hydroforming fluid provided to the interior of the tubular metal blank and expand the diameter of the tubular metal blank so that its exterior surface conforms to that of the internal die surface. The single hydraulic power source also provides the hydraulic fluid under pressure to the hydraulically driven tube-end engaging structure to enable the tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range.

13 Claims, 16 Drawing Sheets

HIGH PRESSURE HYDROFORMING PRESS

This application claims the benefit of U.S. Provisional Patent Application Ser. No. 60/043,950 filed Apr. 16, 1997.

BACKGROUND OF THE INVENTION

The present invention relates to a hydroforming system which requires less capital investment to achieve high pressure hydroforming of tubular parts. The present invention accomplishes this effect by replacing the conventional, separate "intensifier" system for providing high internal pressures within the tubular blank to be expanded.

In accordance with the present invention, water is fed under relatively low pressure to the side ram or hydraulic cylinder assemblies which are used to expand the tubular blank. The side ram assemblies utilize the same hydraulic power source to exert the pressures that are required to expand the tube as well as the pressure that is required to force the opposite ends of the tube inwardly to retain the desired wall thickness of the resultant product. Thus, no separate intensifier is required.

In particular, it is an object of the present invention to provide an apparatus for hydroforming a tubular metal blank that comprises a die structure, a hydroforming fluid source, a hydraulically driven tube-end engaging structure, a hydraulically driven pressure intensifying structure, and a single hydraulic power source. The tube-end engaging structure seals opposite ends of the tubular metal blank in said die cavity and is movable to longitudinally compress the tubular metal blank. The tube-end engaging structure receives hydroforming fluid from said hydroforming fluid source and has a hydroforming fluid supplying outlet through which hydroforming fluid can be provided to the tubular metal blank. The hydraulically driven pressure intensifying structure is movable to pressurize the hydroforming fluid provided to the interior of the tubular metal blank and thereby expand a diameter of the blank. A single hydraulic power source provides the hydraulic fluid under pressure to said hydraulically driven pressure intensifying structure in order to move the pressure intensifying structure and thereby pressurize the hydroforming fluid provided to the interior of the tubular metal blank and expand the diameter of the tubular metal blank so that its exterior surface conforms to that of the internal die surface. The single hydraulic power source also provides the hydraulic fluid under pressure to the hydraulically driven tube-end engaging structure to enable the tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range.

The present invention preferably also utilizes the same hydraulic power source to also apply the downward pressure to an upper die structure when the upper die structure is in its lowered position to oppose the internal die cavity pressure during tube pressurization.

Conventional hydroforming utilizes low pressure (e.g., force of gravity) hydroforming fluid feed from a supply tank to supply hydroforming fluid for quick pre-filling of the tube blank after the die cavities have closed on the tube but prior to the axial cylinders engaging and the tube blank into the cavity. It is a further object of the present invention to use the hydroforming fluid from this same tank to supply a relatively smaller amount of water to intensify the pressure within the tubular blank after it is sealed and is ready to be expanded. This smaller amount of water is supplied to a dual function cylinder used for pushing the tube blank into the die cavity as well as intensifying the fluid pressure inside the die cavity from one side of the tool. By replacing the current intensifiers with a dual function cylinder that supplies the hydraulic push to the tube blank and the internal fluid pressure for forming, the overall cost of the equipment is reduced substantially.

In particular, the object is achieved by providing an apparatus for hydroforming a tubular metal blank comprising a die structure, a hydroforming fluid source, a hydraulically driven tube-end engaging structure, and a hydraulically driven pressure intensifying structure. The die structure has an internal die surface defining a die cavity. The die cavity is constructed and arranged to receive the tubular metal blank. The hydroforming fluid source is disposed higher than the die cavity, and is constructed and arranged to provide hydroforming fluid internally to the tubular metal blank under the force of gravity. The hydraulically driven tube-end engaging structure engages and substantially seal opposite ends of the tubular metal blank in the die cavity. The tube-end engaging structure is movable to longitudinally compress the tubular metal blank. The tube-end engaging structure receives hydroforming fluid from the hydroforming fluid source and has a hydroforming fluid supplying outlet through which hydroforming fluid can be provided to an interior of the tubular metal blank. The hydraulically driven pressure intensifying structure is movable in response to hydraulic fluid pressure to pressurize the hydroforming fluid provided to the interior of the tubular metal blank and thereby expand a diameter of the blank until an exterior surface of the tubular metal blank generally conforms to that of the internal die surface. The hydraulically driven tube-end engaging structure is movable in response to hydraulic fluid pressure to enable the tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range.

The resultant system is much less complex, less cumbersome, and less expensive then conventionally known systems.

Other objects and advantages of the present invention will be appreciated from the following detailed description and appended drawings and claims.

DETAILED DESCRIPTION OF THE PREFERRED EMBODIMENTS

Figure 1:
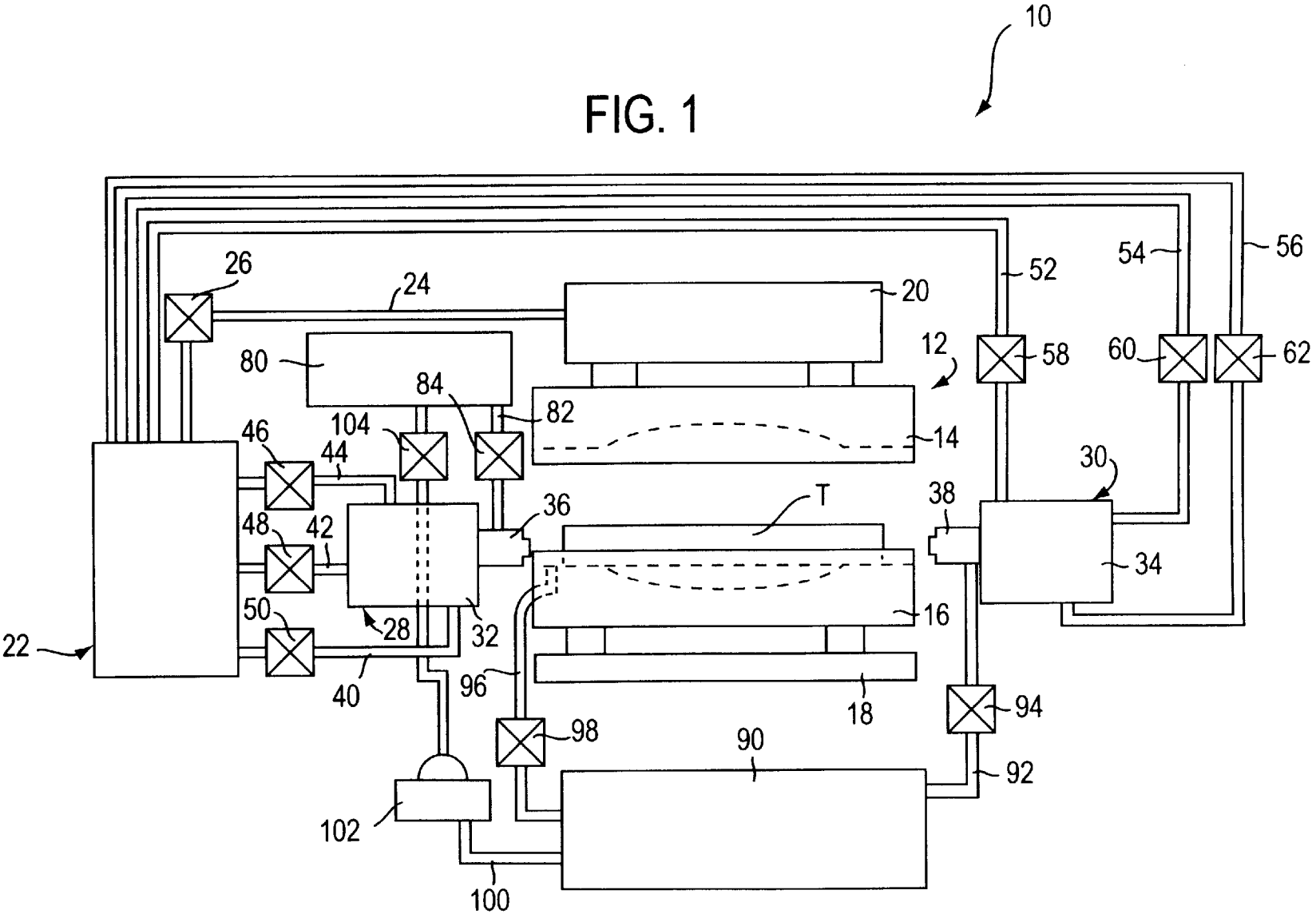
FIG. 1 is a schematic view of a hydroforming press apparatus in accordance with the principles of the present invention.

As shown in FIG. 1, the hydroforming system 10 includes a hydroforming die structure 12, which includes an upper die portion 14 and a lower die portion 16. The lower die portion 16 is mounted on a rigid base 18. The die structure 12 is manufactured substantially in accordance with Ser. No. 60/024,524, filed Aug. 26, 1996, which is hereby incorporated by reference.

As can be appreciated from FIG. 1, the upper die portion 14 is carried by an upper hydraulic ram 20, which controls vertical movement of the upper die portion 14. More particularly, the upper ram 20 is hydraulically actuated to permit the weight of the die portion 14 to move the upper die portion 14 vertically downwardly into cooperation with the lower die portion 16 at the beginning of a hydroforming operation. In addition, after the upper die portion 14 is lowered, the upper ram 20 applies a downward hydraulic force to the upper die portion 14 to maintain the upper die portion 14 in cooperative relation with the lower die portion 16 during high pressure conditions formed within the die cavity between the upper and lower die portions 14,16.

A hydraulic pump assembly 22 is constructed and arranged to provide hydraulic fluid under pressure to the upper ram 20 via hydraulic fluid line 24 to maintain the upper die portion 14 in cooperative relation with the lower die portion against the opposing force created by the high die cavity pressure conditions as aforesaid. A servo valve 26 is disposed in the fluid line 24 to regulate fluid flow between the hydraulic pump assembly 22 and the upper ram 20.

The hydraulic pump assembly 22 is also connected with a pair of side ram assemblies 28 and 30 disposed at opposite longitudinal ends of the die structure 12. The side ram assemblies 28,30 include respective ram housings 32 and 34, and respective tube-end engaging structures 36 and 38. The tube-end engaging structure 36 projects outwardly from the side ram housing 32, and the tube-end engaging structure 38 projects outwardly from the side ram housing 34.

Figure 2:
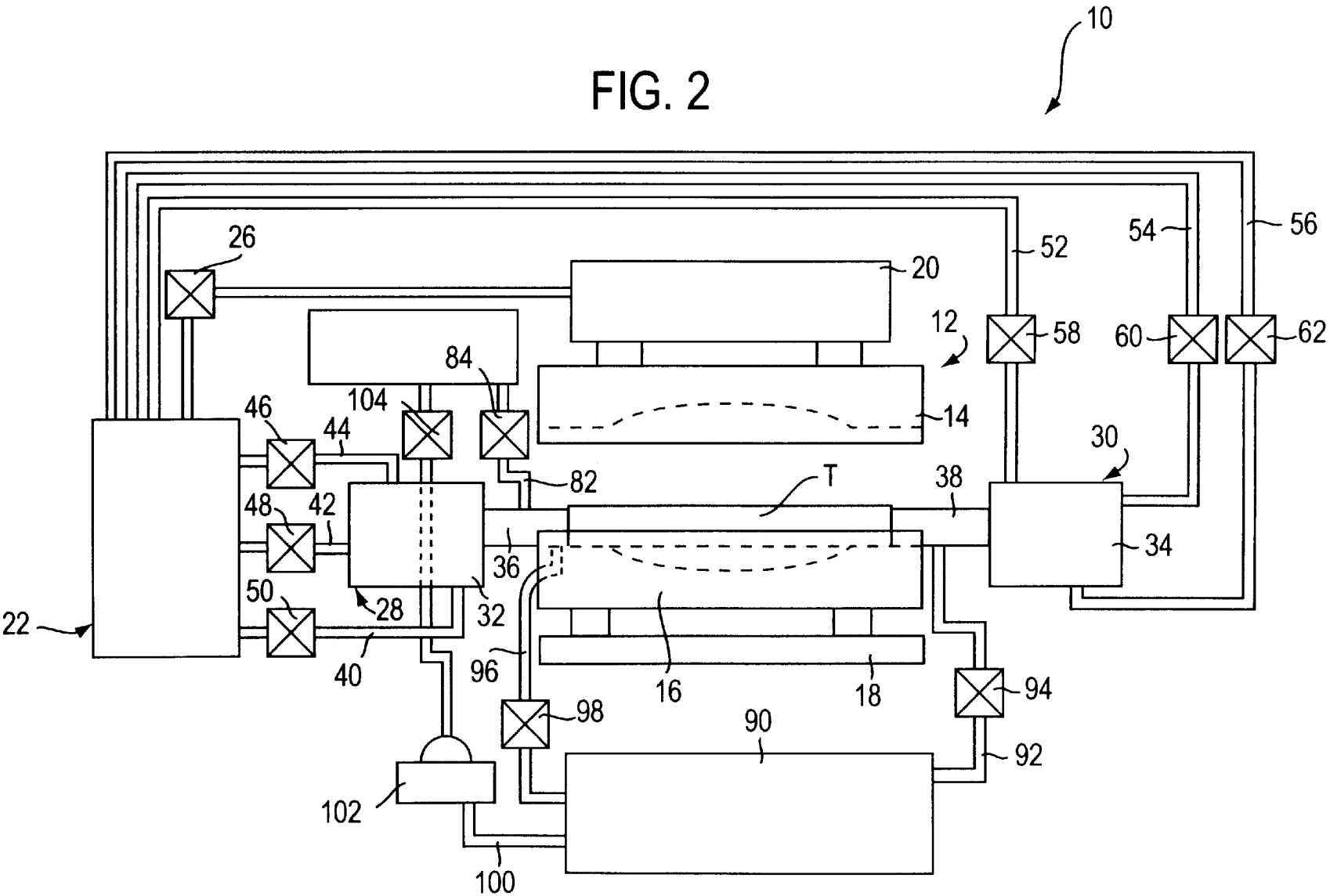
FIG. 2 is a schematic view similar to that shown in FIG. 1, but showing tube-end engaging structures moved into engagement with the opposite ends of the tube to be hydroformed.

As shown in FIG. 2, the tube-end engaging structure 36 is movable inwardly from the ram housing 32 and into engagement and sealing relation with one end of a tube T carried by the lower die portion 16. The tube-end engaging structure 38 is movable inwardly from the ram housing 34 and is constructed and arranged to engage and seal the opposite end of the tube T. The tube-end engaging structure 36 will move inwardly and outwardly with respect to the ram housing 32 based upon hydraulic fluid provided to the side ram assembly 28 by the hydraulic pump assembly 22 through three separate hydraulic fluid lines 40, 42 and 44 as shown. Servo valves 46, 48 and 50 are disposed in the fluid lines 44,42 and 40, respectively, for controlling fluid flow between the pump assembly 22 and side ram assembly 28.

In similar fashion, the side ram assembly 30 is connected with the hydraulic pump assembly 22 for controlled movement of the tube-end engaging structure 38. The side ram assembly 30 is connected with the hydraulic pump assembly 22 via three separate hydraulic fluid lines 52, 54 and 56, as shown. Servo valves 58, 60 and 62 are disposed within the fluid lines 52, 54 and 56, respectively, for controlling fluid flow between the pump assembly 22 and side ram assembly 30.

The hydroforming apparatus 10 further includes an upper water tank 80 constructed and arranged to hold a prescribed amount of water. The water tank 80 is connected via fluid line 82 to the tube-end engaging structure 36 of side ram assembly 28. A servo valve 84 is disposed in the fluid line 82 and controls water flow into the tube-end engaging structure 36 when it is engaged and sealed with the end of tube T. The tube-end engaging structure 36 in turn supplies water to the interior of tube T.

The hydroforming apparatus 10 further includes a lower water tank 90, which is connected to the tube-end engaging structure 38 via water line 92. A servo valve 94 disposed in the water line 92 controls flow of water from the tube-end engaging structure 38 to the lower tank 90.

After the tube-end engaging structures 36,38 are engaged with the opposite ends of the tube T as shown in FIG. 2, valve 84 is opened, and water flows from the upper tank 80, through tube-end engaging structure 36, through the tube T and into the tube-end engaging structure 38.

A drain line 96 is connected from the lower die portion 16 to the lower tank 90. After a hydroforming operation, the drain line 96 drains any remaining water in the lower die portion 16 into the lower tank 90. A servo valve 98 is disposed in the drain line 96 to control the flow of water to the lower tank 90.

After a hydroforming operation, water captured in the lower tank 90 is returned to the upper water tank 80 through return line 100. A simple positive displacement water pump 102 is disposed in the return line 100 to pump the water from the lower tank 90 to the upper water tank 80 through the return line 100. A servo valve 104 is disposed in the return line 100 to regulate the flow of fluid from the lower tank 90 to the upper water tank 80.

The hydroforming apparatus 10 will now be described in more detail in FIG. 3. As shown, the ram housing 32 of side ram assembly 28 houses the tube-end engaging structure 36 and a pressure-intensifying structure 110. As shown, the tube-end engaging structure 36 comprises a main portion 112 and an end cap 114. More particularly, the main portion includes a tubular sleeve portion 116 and a radially outwardly extending flange portion 118 extending radially outwardly from the rearward end of the sleeve portion 116. The outer peripheral edge 119 of the flange portion 118 is disposed in a slidably sealed relationship with a cylindrical inner side surface 120 of the ram housing 32. Similarly, an outer cylindrical surface 122 of the sleeve portion 116 is disposed in sliding and sealed relation with a cooperating surface 128 generally defining an opening in the ram housing 32 through which the tube-end engaging structure 36 projects.

The end cap 114 includes an annular flange portion 130 bolted and sealed by virtue of appropriate fasteners 132 to the circular distal end of the sleeve portion 116, which is disposed outwardly of the ram housing 32. The end cap 114 further includes an elongated tubular portion 134 integrally formed with the flange portion 130 and extending axially in an outward direction with respect to sleeve portion 116. The tubular portion 134 has a generally cylindrical exterior surface 136, which is constructed and arranged to form a peripheral seal with an arcuate upper die surface portion 138 of the upper die portion 14 and an arcuate lower die surface 140 of the lower die portion 16 when the upper die portion 14 is closed.

The end cap 114 terminates in a nozzle portion 144 which projects outwardly from the tubular portion 134. The nozzle portion 144 is substantially tubular in shape, and is of a reduced outside diameter in comparison with the tubular portion 134. A radially extending annular flange portion 146 is disposed at the transition between the tubular portion 134 and the nozzle portion 144. The flange portion 146 is constructed and arranged to engage in sealing relation with one end of a tube T disposed in the die structure 12 during a hydroforming operation. The nozzle portion 144 has a cylindrical exterior surface 148 constructed and arranged to be received within one end of the tube T. It may be preferable for the surface 148 to form an interference fit with the interior wall of the tube T at said one end.

A longitudinal bore 150 extends through the end cap 114 and is constructed and arranged to communicate fluid from within the tube-end engaging structure 36 to the inner confines of the tube T.

The pressure intensifying structure 110 has a generally disk-shaped base portion 160 having an annular outer periphery disposed in a slidably sealed relationship with the inner surface 120 of the ram housing 32. A solid cylindrical intermediate block portion 162 is integrally formed with base portion 160 and of decreased diameter in comparison with the base portion 160. A solid cylindrical forward portion 164 is integrally formed with intermediate portion 162 and is of decreased diameter in comparison with intermediate portion 162. Forward portion 164 extends from the intermediate block portion 162 into the inner confines of the sleeve portion 116 of the outer ram 36. The exterior surface of forward portion 164 has a generally cylindrical outer surface disposed in a slidably sealed relationship with the generally cylindrical cooperating interior surface of the sleeve portion 116.

At the transition between the forward portion 164 and the intermediate block portion 162 is a radially extending annular flange surface 168. The flange surface 168 serves as a rearward stop for the tube-end engaging structure 36.

Figure 3:
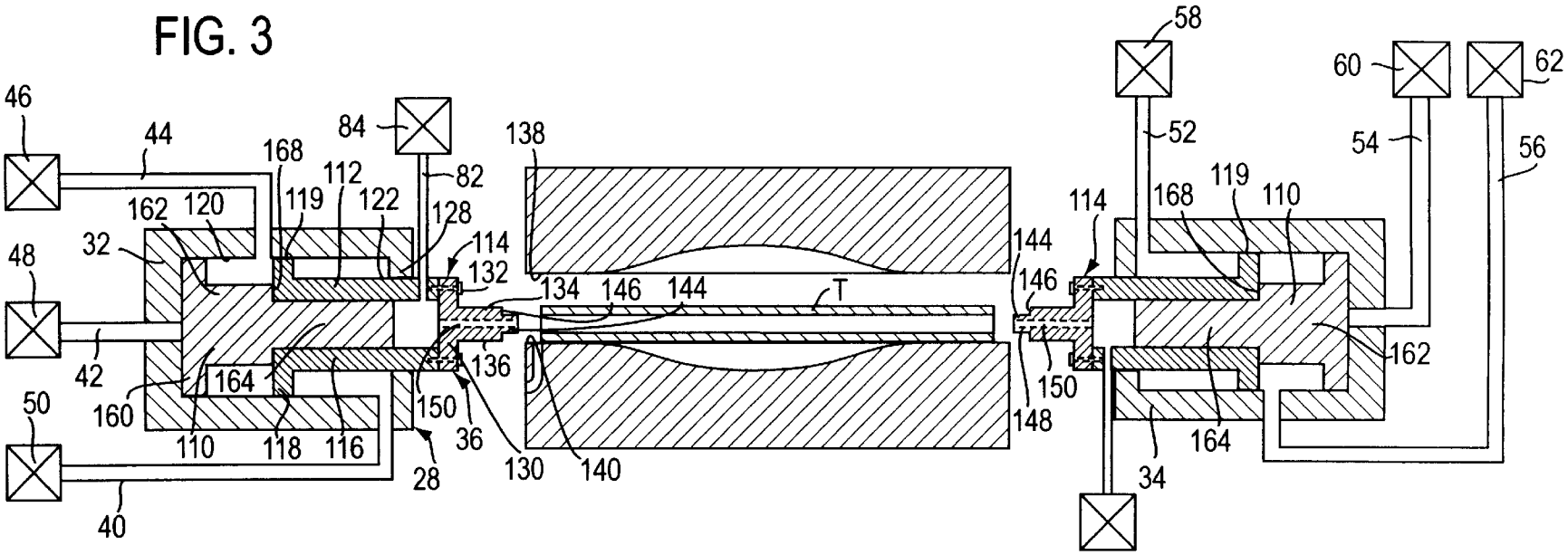
FIG. 3 is a schematic cross-sectional view of the hydraulic side ram assemblies and the die structure in accordance with the present invention.

In FIG. 3, the tube-end engaging structure 36 and the pressure intensifying structure 110 are shown in their rearward-most positions within the ram housing 32.

It should be appreciated that side ram assembly 30 is substantially identical to side ram assembly 28, with the exception of the connections to the lower tank 90 for the ram assembly 30 versus the connection to the upper tank 80 for the ram assembly 28. Thus, in the figures, similar elements for the two ram assemblies 28 and 30 are given the same reference numerals.

Operation of the system will now be described.

Figure 4:
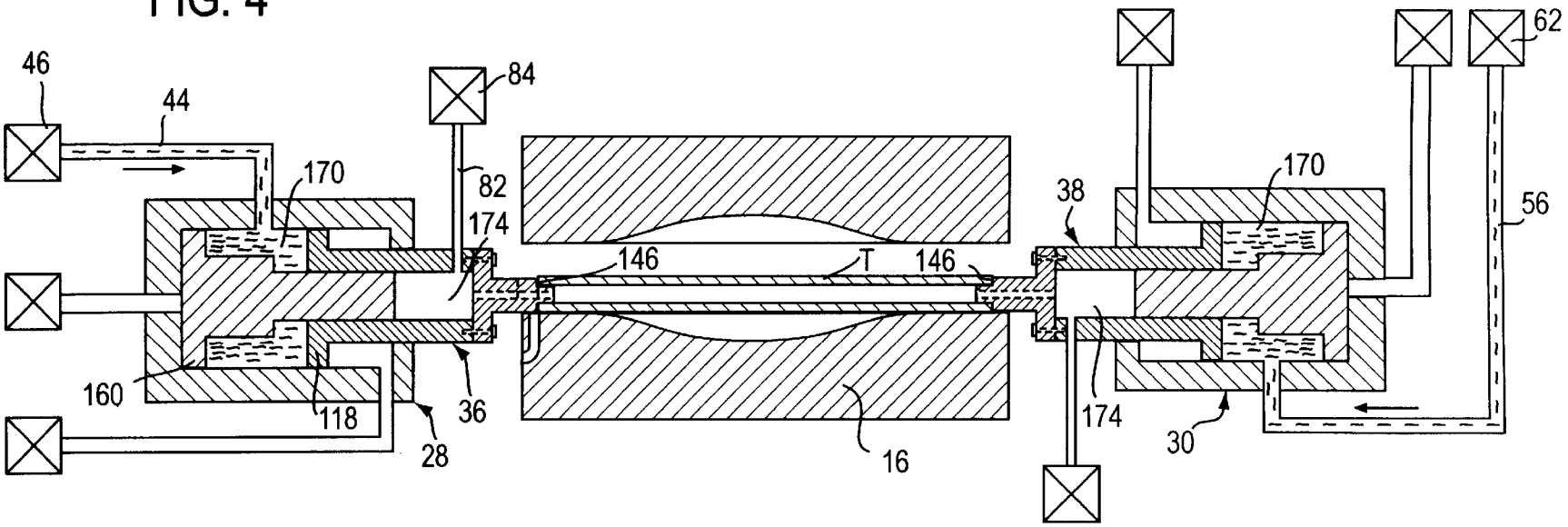
FIG. 4 is a view similar to that shown in FIG. 3, but showing the tube-end engaging structures of moved into engagement with the opposite ends of the tubular blank to be hydroformed.

As shown in FIG. 4, after the tube T is placed in the lower die structure 16, servo valve 46 is opened and hydraulic fluid is provided under pressure from the hydraulic pump assembly 22 through the fluid line 44 into an intermediate chamber 170 generally between the flange portion 118 of tube-end engaging structure 36 and the base portion 160 of pressure intensifying structure 110 in housing 32. Similarly, servo valve 62 is opened so that hydraulic pump assembly 22 can provide hydraulic fluid through fluid line 56 into the intermediate chamber 170 in side ram assembly 30. When fluid is provided to the side ram assemblies 28 and 30 in such a fashion, the tube-end engaging structures 36 and 38 are moved inwardly toward one another so that the flange portion 146 of each engage and seal the opposite ends of the tube T.

Figure 5:
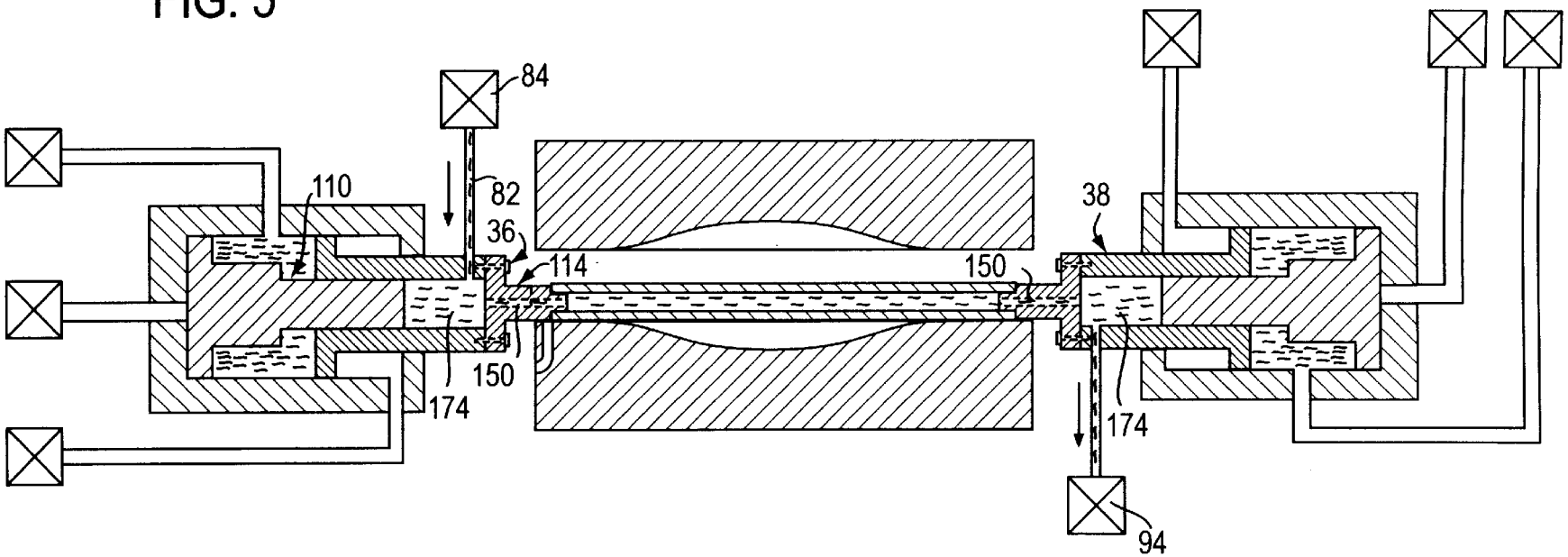
FIG. 5 is a view similar to that shown in FIG. 4, with the valve open to initiate pressurization of the tube to be hydroformed.

Next, as shown in FIG. 5, servo valve 84 is opened to permit water flow from the upper water tank 80 through fluid line 82 into a pressure intensifying chamber 174 disposed within the confines of tube-end engaging structure 36, between innermost end of pressure intensifying structure 110 and the end cap 114. The fluid travels through the bore 150 of the tube-end engaging structure 36 into the tube T, and is subsequently communicated through the bore 150 in the opposite outer ram 38 into the forward chamber 174 of the outer ram 38. During this process of filling the tube T, servo valve 94 is initially opened and hence permits fluid flow to the lower tank 90. With this flow of fluid through the tube T, substantially all air bubbles are purged from the tube T. Subsequently, the servo valve 94 is closed and tube T is pressurized to a predetermined extent.

Figure 6:
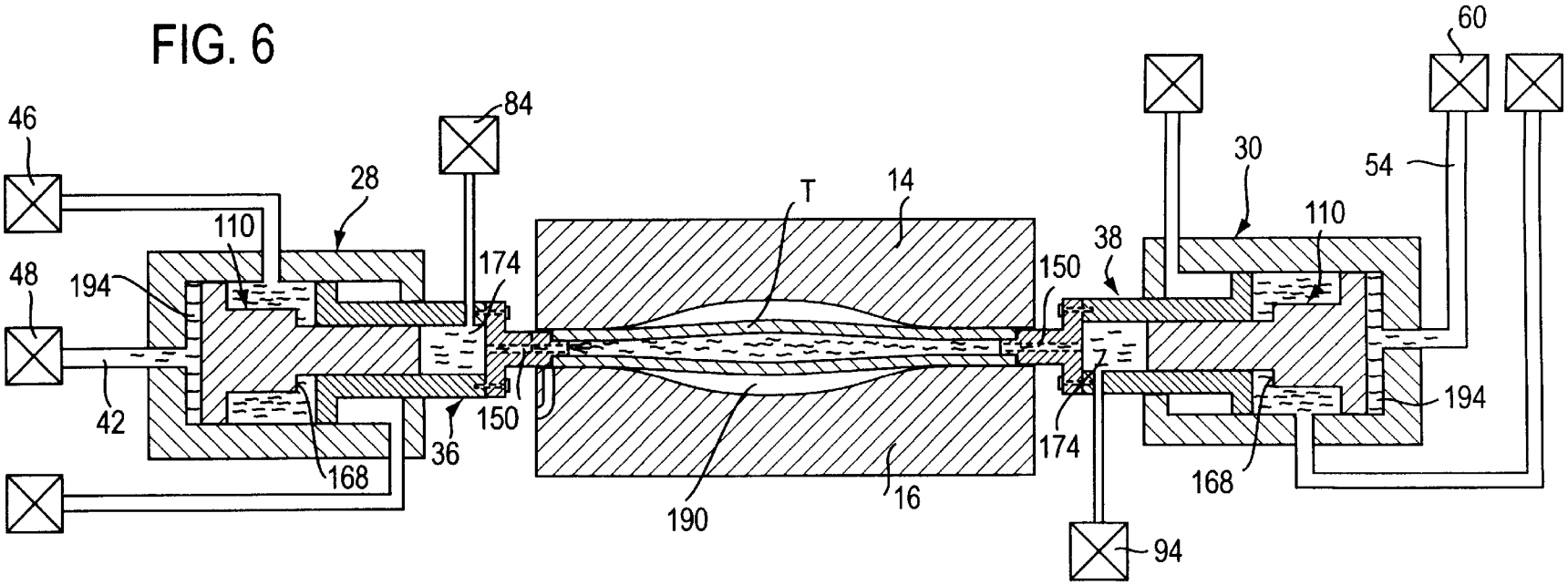
FIG. 6 is a view similar to that shown in FIG. 5, but showing the initial pressurization of the tube to be hydroformed, and with the upper die structure in a lowered position.

As shown in FIG. 6, after the tube T is filled with fluid, the upper die portion 14 is lowered onto the lower die portion 16 to form a closed die cavity 190, preferably having a boxed cross-sectional shape therebetween.

Upon lowering of the upper die portion 14, the servo valve 84 connected with the tube-end engaging structure 36 and the servo valve 94 connected with the tube-end engaging structure 38 are closed. Subsequently, servo valves 48 and 60 are opened, and hydraulic fluid under pressure is provided by hydraulic pump assembly 22 through the hydraulic lines 42 and 54 to pressurize rearward chambers 194 disposed rearwardly of pressure intensifying structures 110 of the associated side ram assemblies 28 and 30. The fluid provided within the rearward chambers 194 causes movement of the pressure intensifying structures 110 inwardly toward one another so as to displace the water within the pressure intensifying chambers 174 through the fluid supplying outlets 150 and into the tube T. As shown, forced movement of the incompressible water contained in pressure intensifying chambers 174 into the tube T causes an initial diametrical expansion of the tube T.

Figure 7:
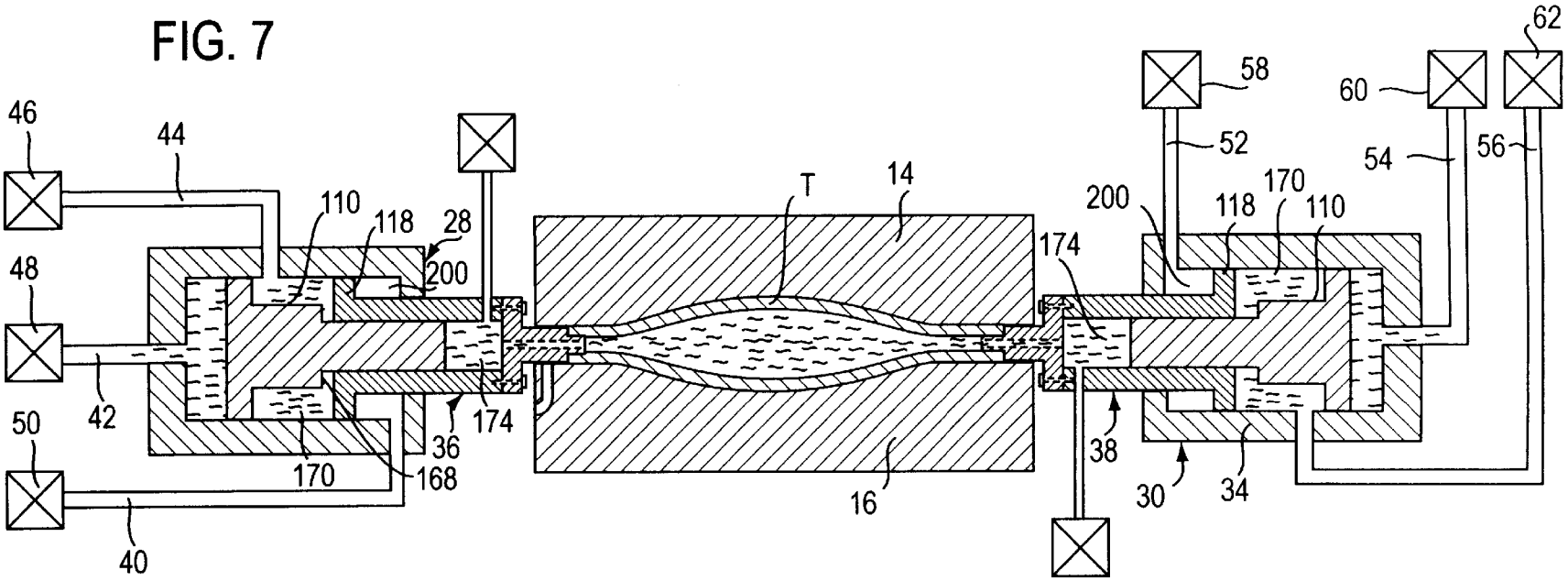
FIG. 7 is a view similar to that shown in FIG. 6, but shows the full expansion of the tubular blank and inward movement of the hydraulic side ram assemblies to maintain the wall thickness of the part being formed.

As shown in FIG. 7, pressure intensifying structures 110 continue to be forced inwardly toward one another to displace the water in the pressure intensifying chambers 174 and further diametrically expand the tube T. The servo valves 46 and 62 remain open to permit pressurized hydraulic fluid to continue to flow from pump assembly 22 through hydraulic lines 44 and 56 to pressurize the intermediate chambers 170 of side ram assemblies 28 and 30. Fluid provided under pressure into the intermediate chambers 170 causes the tube-end engaging structures 36 and 38 to move longitudinally and inwardly toward one another and against the opposite ends of the tube T. Movement of the outer rams 36 and 38 in this fashion causes the metal material forming the tube T (preferably steel) to flow along the length of the tube so that the diameter of the tube can be expanded in some areas by 10% or greater, while the wall thickness of the hydroformed tube T is maintained preferably within ±10% of the wall thickness of the original tube blank.

Most preferably, fluid pressure between 2,000 and 3,500 atmospheres is used to expand the tube. Depending upon the application, it may also be preferable to utilize pressures between 2,000 and 10,000 atmospheres, although even higher pressures can be used.

Figure 8:
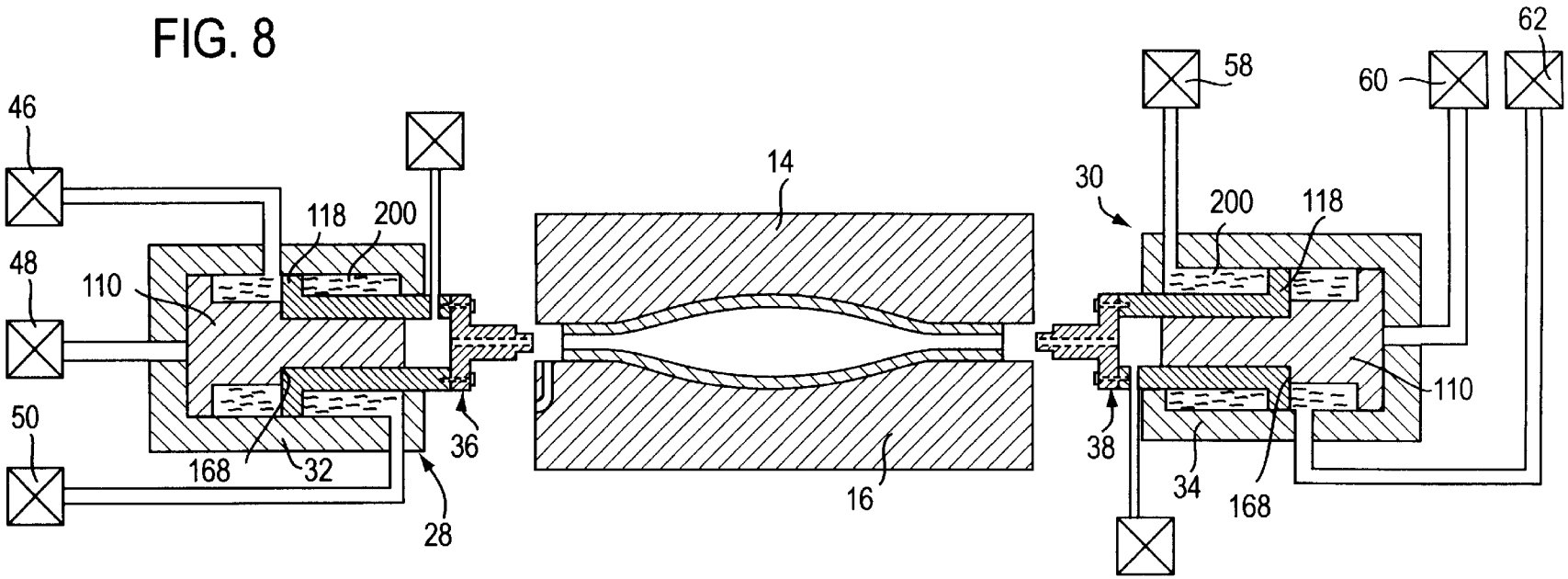
FIG. 8 shows the subsequent step to that in FIG. 7 in which the outer rams are returned toward their original position within the side ram assemblies after a hydroforming operation.

After the tube T is formed into the desired shape, corresponding to the shape of the die cavity, pump 22 ceases to pressurize fluid lines 42, 44, 54 and 56. Then valves 50 and 58 are opened to permit hydraulic fluid flow under pressure from the hydraulic pump assembly 22 through the fluid lines 40 and 52. As a result, hydraulic fluid is provided under pressure to return chambers 200 disposed forwardly of the flange portion 118 of the tube-end engaging structures 36 and 38 as shown. Pressurization of the return chambers 200 drives the tube-end engaging structures 36 and 38 outwardly within the respective ram housings 32 and 34 so as to move the tube-end engaging structures 36 and 38 out of engagement with the opposite ends of the tube T, as shown in FIG. 8.

As the tube-end engaging structures 36 and 38 are driven outwardly within the ram housings 32 and 34, the flanges 118 engage the forwardly facing flange surfaces 168 of the pressure intensifying structures 110 and drive the pressure intensifying structures 110 outwardly. Eventually the pressure intensifying and tube-end engaging structures reach their original positions, as can be appreciated from a comparison between FIGS. 3 and 8.

During this outward movement of the pressure intensifying structures 110 and tube-end engaging structures 36 and 38, the valves 48, 46, 60 and 62 are open to permit back flow of hydraulic fluid into a hydraulic fluid reservoir contained in the hydraulic pump assembly 22.

After the tube-end engaging structures 36 and 38 are disengaged with the opposite ends of the tube T, water remaining in the tube-end engaging structures and the tube T is drained through the drain line 96 past the open servo valve 98 and into the lower tank 90. The water contained in the lower tank 90 is recycled to the upper tank 80 through the return line 100 when the water pump 102 is activated.

Advantageously, because the side ram assemblies 28 and 30 of the present invention employ pressure intensifying structures 110 within tube-end engaging structures 36 and 38, there is no need to provide a separate, costly "intensifier" system for providing high internal pressures to expand the tube. Such intensifiers are normally required in high pressure hydroforming systems (ire., hydroforming systems that utilize hydraulic expansion pressures greater than 2,000 atmospheres), and heretofore have been particularly required in high pressure hydroforming operations in which the opposite ends of a tube are engaged and forced inwardly to effect metal material flow along the length of the tube to replenish or maintain the wall thickness of the tube during expansion thereof. Conventionally, intensifiers have been used in conjunction with separate side ram members that are used only to push the opposite ends of the tube inwardly to effect the aforementioned material flow.

The present invention accomplishes the same desired function as a hydroforming system having the conventional intensifier, but is much more cost-effective. In the present invention, water is fed under relatively low pressure, preferably by force of gravity (or a simple low pressure circulation pump), to the side ram assemblies. The side ram assemblies then utilize the same hydraulic power source (e.g., hydraulic pump 22) to exert the pressures that are required to expand the tube as well as the pressures that are required to force the opposite ends of the tube inwardly to retain the desired wall thickness.

Another advantageous feature of the present invention is the use of the same hydraulic pump 22, used as aforementioned, to also apply the downward pressure to the upper die portion 14 when the upper die portion 14 is in its lowered position. The hydraulic pump 22 effects a downward force on the upper die portion 14 to oppose the internal die cavity pressure during tube pressurization and thus retain the upper die portion 14 in the lowered position. In addition, the final system is less complex and less cumbersome than the conventional system.

Referring now to FIGS. 9–16, an enlarged partial view of a second embodiment of a hydroforming system is generally indicated at 220, in accordance with the principles of the present invention. The preferred apparatus is comprised of five main assemblies: a frame assembly generally providing structural support and generally indicated at 222, an upper press assembly generally indicated at 224, a lower press assembly generally indicated at 226, a hydroforming die structure generally indicated at 228, and a hydraulic line assembly generally indicated at 230.

Figure 9:
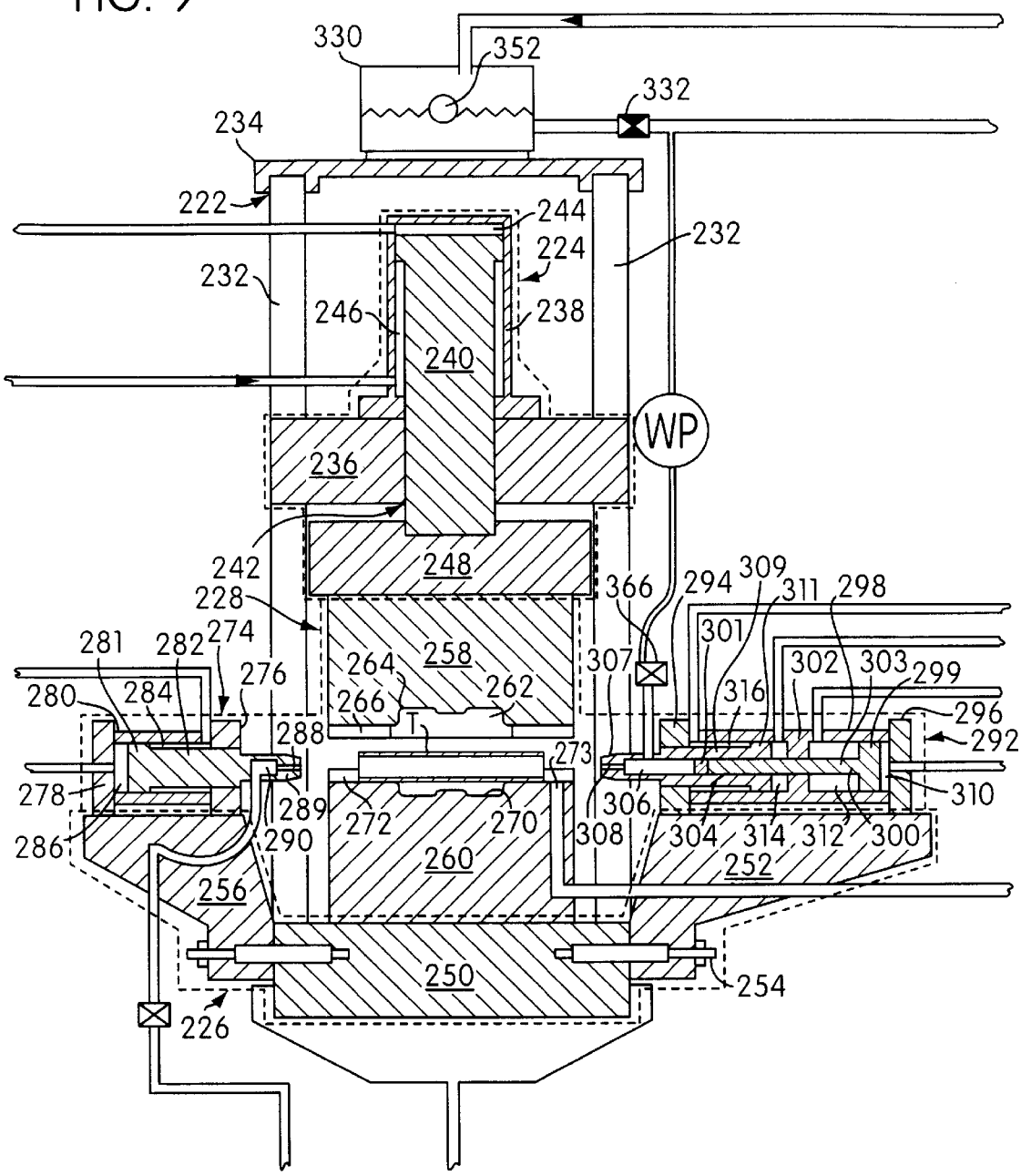
FIG. 9 is an enlarged schematic partial view of a second embodiment of a hydroforming press apparatus in accordance with the principles of the present invention, and showing the press in the open position.

Referring particularly to FIG. 9, the frame assembly 222 includes a pair of press side frame members 232 depicted as parallel laterally spaced elongate vertical members for mounting the upper press assembly 224 and lower press assembly 228. The upper ends of the side frame members 232 have a crown plate 234 mounted across the tops thereof. The crown plate 234 serves as support for parts of the hydraulic fluid system, to be described later.

The upper press assembly 224 is configured as follows. A cylinder mount platen 236 is secured at its ends to the press side frame members 232. Generally centrally disposed on the cylinder mount platen 236 is a ram cylinder 238 having a ram piston rod 240 that extends through a vertically disposed piston rod opening 242 in the cylinder mount platen 236. An upper portion of the piston rod 240 has an expanded outer diameter allowing the upper portion of the rod 240 to be disposed in sliding sealed engagement with interior surface of cylinder 238. A space defined by the upper portion of the piston rod 240 and the interior surfaces of the cylinder 238 define an upper pressure chamber 244. The piston rod diameter below the described upper end portion is slightly reduced and defines a lower pressure chamber 246 between the cylindrical, outer surface of the rod 240 and interior surfaces of the cylinder 238. The lower pressure chamber 246 is defined at its lower end by a radially inwardly extending portion of the base of the cylinder 238 and at its upper end by the annular lower surface of the larger diameter upper portion of the piston rod 240. Fixedly secured to the lower end of the piston rod 240 is a pressure ram 248. The pressure ram 248 extends horizontally and does not quite span the lateral space between the two frame members 232.

The lower press assembly 226 includes a press bed 250, a right outrigger 252 fixedly secured to the press bed 250 by a tie bolt 254, and a left outrigger 256 fixedly secured to the press bed 250 by means of another tie bolt 254. The press bed 250 supports a lower die half 260 and provides a foundation for other assemblies. The lower ends of the press side frame members 232 are securely fixed to the press bed 250 near the opposite ends of the bed 250. Fixedly secured to the lateral ends of the press bed and rising generally upwardly and laterally outwardly from the bed 250 are the right outrigger 252 and left outrigger 256 that provide support for hydraulically driven assemblies cylinders 274 and 292, which will be described below.

Referring further to the hydroforming system 220 embodied in FIG. 9, he die structure 228 (which is enlarged in FIG. 16) is comprised of an upper die half 258 and a lower die half 260. Cylinders 274 and 292 are mounted on the aforementioned left and right outriggers. The die halves 258 and 260 have respective internal surfaces 264 and 270 that cooperate to define a die cavity 262 that defines the size and shape into which a tube blank is to be hydroformed. The top upper portion of the upper die half 258 is fixedly to the bottom of the press ram 248. The lower die half 260 is fixedly mounted on the press bed 250.

The lower die half 260 is of the same general size and shape as the upper die half 258, but its internal die surface 264 is inverted relative to the lower die cavity surface 270. Disposed in the upper and lower die halves 258 and 260 are upper and lower tool nests or clamping structures 266 and 272 that cooperate to surroundingly clamp the exterior surface of tube blank T near each of its longitudinal ends and thereby secure the tube blank within the closed die. A fluid inlet 273 is disposed in one of the lower tool nests and will be described in greater detail later. Disposed along the axis of the die cavity and tool nests 266 and 272, and mounted beyond the press side frame members 232 on the outriggers 252 and 256, are a pair of hydraulically driven assemblies 274 and 292, aligned with said tube axis and directed toward the ends of the tube blank T.

One of the cylinders 274, mounted on the left outrigger 256, is a lateral push cylinder. This cylinder 274 consists of a front member 276 and a rear member 278 that are secured to the top surface of the left outrigger 256, and a cylindrical wall member 280 secured between the front and rear members 276 and 278. The front member 276 has a central opening allowing sliding, sealed movement therethrough by a tube-end engaging structure 282. The rear end 281 of the tube-end engaging structure 282 is disposed within the cylinder 274 and is of a diameter disposed in sliding sealed relation with the inside surface of the cylindrical wall member 280. The more forward portions of the tube-end engaging structure 282 are of less diameter than the described rear end portion, creating a lateral cylinder chamber 284 defined by the exterior cylindrical side surfaces of tube-end engaging structure 282, the cylindrical inside surface of the cylindrical wall member 280, the annular inwardly facing surface of the back end 281 of the tube-end engaging structure 282, and the annular rearwardly facing interior surface of the front member 276 of the cylinder 274. A rear pressurizing chamber 286 is defined by the forwardly facing, interior surface of the rear member 278 of the cylinder 274, the cylindrical wall member 280 and the back surface of the back end portion 281 of the tube-end engaging structure 282. These chambers 284 and 286 communicate with hydraulic fluid lines, as will be discussed. A front end portion of the tube-end engaging structure 282 that protrudes beyond the front member 276 of the cylinder 274 is of slightly reduced diameter, and at the forward end of this front portion of the piston rod is a tube engaging portion in the form of a tapered nose section 288. The tapered nose section 288 is constructed and arranged to be received within the open end of a tube blank T to be hydroformed. The rearward portion of the tapered nose section 288 preferably has a radially outwardly extending annular flange (not shown) which abuts against the end edge of the tube blank T to enable nose section 288 to apply a substantial force against the tube end in the longitudinal tube direction. A relatively fine bore defining a fluid outlet 289 is formed through the nose section 288 and extends from an internal chamber 290 within the inwardly extending portion of tube-end engaging structure 282 to communicate fluid from chamber 290 into the tube blank T when the nose section 288 is engaged in a sealed relation with the end of blank T.

On the opposite side of the hydroforming press bed 250 and mounted securely to the top of the right outrigger 252 is a hydraulically driven duplex cylinder assembly 292. The duplex cylinder assembly 292 has an inner wall 294 and an outer wall 296 fixed securely to the right outrigger 252. A cylindrical wall member 298 secured between the inner wall 294 and outer wall 296 to define a cylinder chamber. Disposed within the interior of the duplex cylinder assembly 292 is a hydraulically driven pressure intensifying structure 300 and a hydraulically driven tube-end engaging structure 304. The hydraulically driven pressure intensifying structure 300 has an outer end portion 299 disposed in slidingly sealed relation with an interior surface of cylindrical wall member 298 and a inwardly extending portion 303 having a relatively reduced diameter. The reduced diameter inwardly extending portion 303 of the pressure intensifying structure 300 passes in slidingly sealed relation through an opening formed in an annular cylinder divider 302 disposed about midway along the longitudinal axis of the cylindrical wall member 298. The hydraulically driven tube-end engaging structure 304 within the duplex cylinder assembly 292 is tubular and disposed inwardly of the cylinder divider 302. The tube-end engaging structure 304 has a rear end portion 311 movable in a slidably sealed relation with the inside surface of the cylinder wall 298. A main longitudinal cylindrical sleeve portion 309 having a reduced diameter extends inwardly through and moves in slidably sealed relation with an opening formed in the inner wall 294. A tube-end engaging portion in the form of a tapered nose portion 307 is defined on the innermost end of the cylindrical sleeve portion 309. The nose portion has a similar configuration to nose portion 288 as previously described. The inwardly extending portion 303 of the pressure intensifying structure 300, with high-pressure seals 301 secured to its innermost end, is slidingly mounted within the cylindrical sleeve 309 of the ram structure 304. Defined inwardly of the high pressure seals 301 of the pressure intensifying structure 300 and within the ram structure 304 is an intensifier fluid chamber 306.

The nose portion 307 has a relatively fine bore defining a fluid outlet 308 formed therethrough extending inwardly from the intensifier chamber 306 and opening through an innermost portion of the tapered nose portion 307 to enable the chamber 306 to fluidly communicate with the adjacent end of tube blank T.

A pressurizing chamber 310 is defined between the rear end portion 299 of the hydraulically driven pressure intensifying structure 300 and the outer wall 296 of the duplex cylinder 292. A return chamber 312 is defined between the annular inwardly facing surface of the outer end portion 299 of the pressure intensifying structure 300 and the outwardly facing surface of the cylinder divider 302. A tube-end engaging structure pressure chamber 314 is formed between the inwardly facing surface of the cylinder divider 302 and the outwardly facing surface of the outer end portion 311 of the hydraulically driven tube-end engaging structure 304. A tube-end engaging structure return chamber 316 is defined around the cylindrical sleeve portion 309 of the tube-end engaging structure 304 between the outer end portion 311 of the ram tube-end engaging structure 304 and the inner wall 294 of the duplex cylinder assembly 292. These chambers have openings to fluid lines, as will be described below.

The hydroforming assembly 220 illustrated in FIGS. 9 to 16 includes a hydraulic line assembly 230 consisting of fluid lines, reservoirs, pumps and valves, as will be described in conjunction with the following description of operation of the invention.

Figure 10:
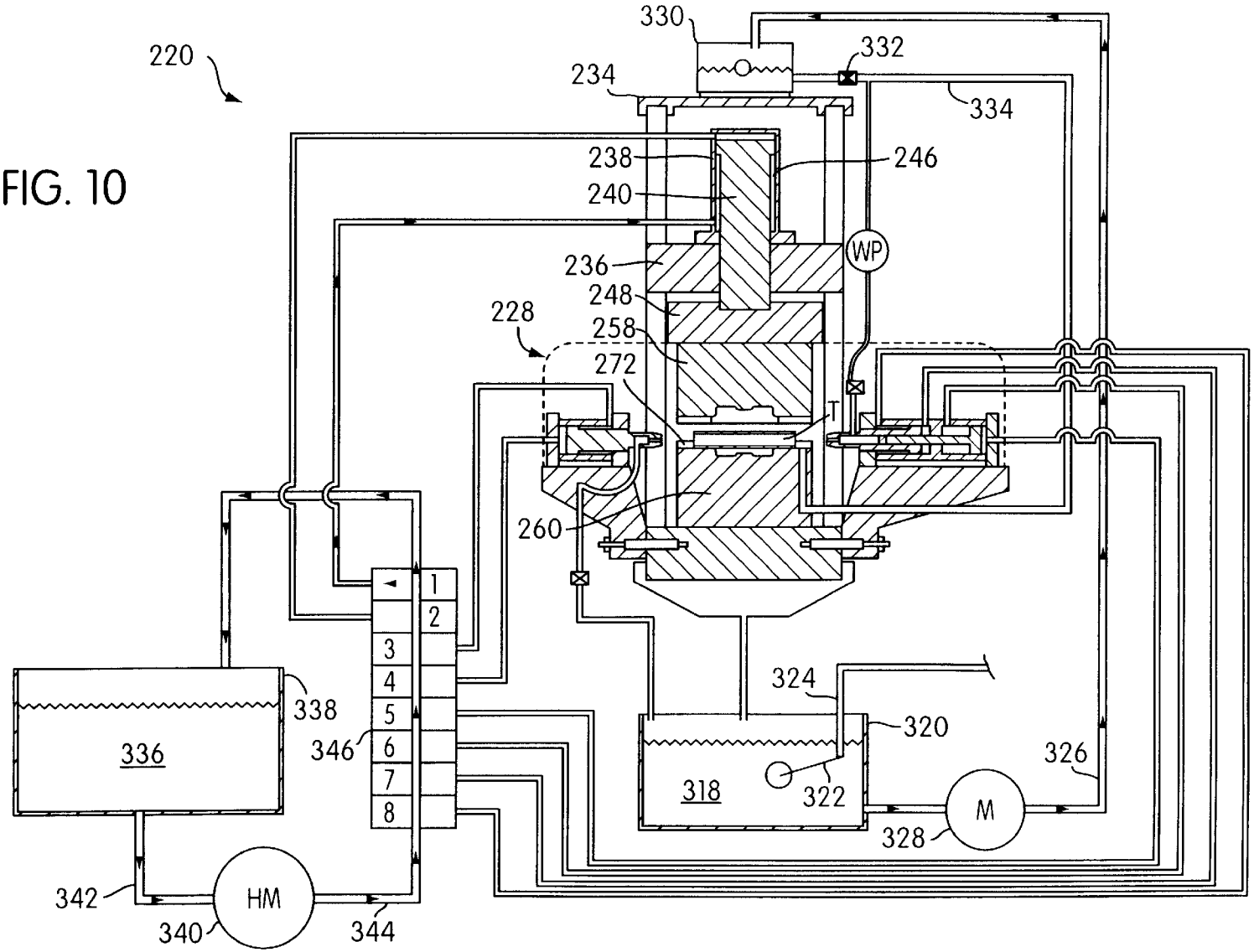
FIG. 10 is a schematic view of the complete hydroforming press apparatus partially embodied in FIG. 9, and showing the press in the open position.

FIGS. 9 and 10 show the hydroforming die assembly 228 in its open position. Referring particularly to FIG. 10, in the open position, the press ram 248 and upper die half 258 are raised. Hydroforming fluid 318, which is a combination of tap water and chemicals, is stored in a lower reservoir filter tank 320. This tank 320 has a float valve 322 that is connected to a water/chemical mixer via line 324 provided for evaporation and other fluid loss makeup. The fluid 318 is pumped through line 326 by a tank motor/water pump 328 to an upper gravity feed tank 330 which is mounted on the crown plate 234. An upper tank outlet line 334 is connected to tank 330. A shut-off valve 332 on line 334 is in the closed position in FIGS. 9 and 10, allowing the upper gravity feed tank 330 to be filled via line 326.

The hydroforming apparatus 220 includes a hydraulic fluid reservoir 338 that stores hydraulic fluid 336, preferably oil. A single hydraulic power source in the form of a high pressure hydraulic pump 340 draws the hydraulic fluid 336 through line 342, and then pumps the fluid 336 through line 344 to a control valve assembly 346 comprised of a plurality of valves (1–8). The valves No. 2 to No. 8 are shown in their closed position in FIG. 10. After fluid 336 passes through the control valve assembly 346, it returns to the hydraulic reservoir 338 via line 344, allowing the hydraulic pump and motor 340 to operate in a free wheel mode.

As stated previously, in FIG. 10 the press ram 248 is in the open or raised position and is supported by the piston rod 240, ram cylinder 238 and the cylinder mount platen 236. The piston rod 240 is held in its raised position by valve No.1 being opened and hydraulic fluid 336 being pumped through line 348 into pressurizing chamber 246 within the press ram cylinder 238. With the upper die half 258 raised, the tube blank T can be positioned on the lower tool nests 272 of the lower die half 260.

Figure 11:
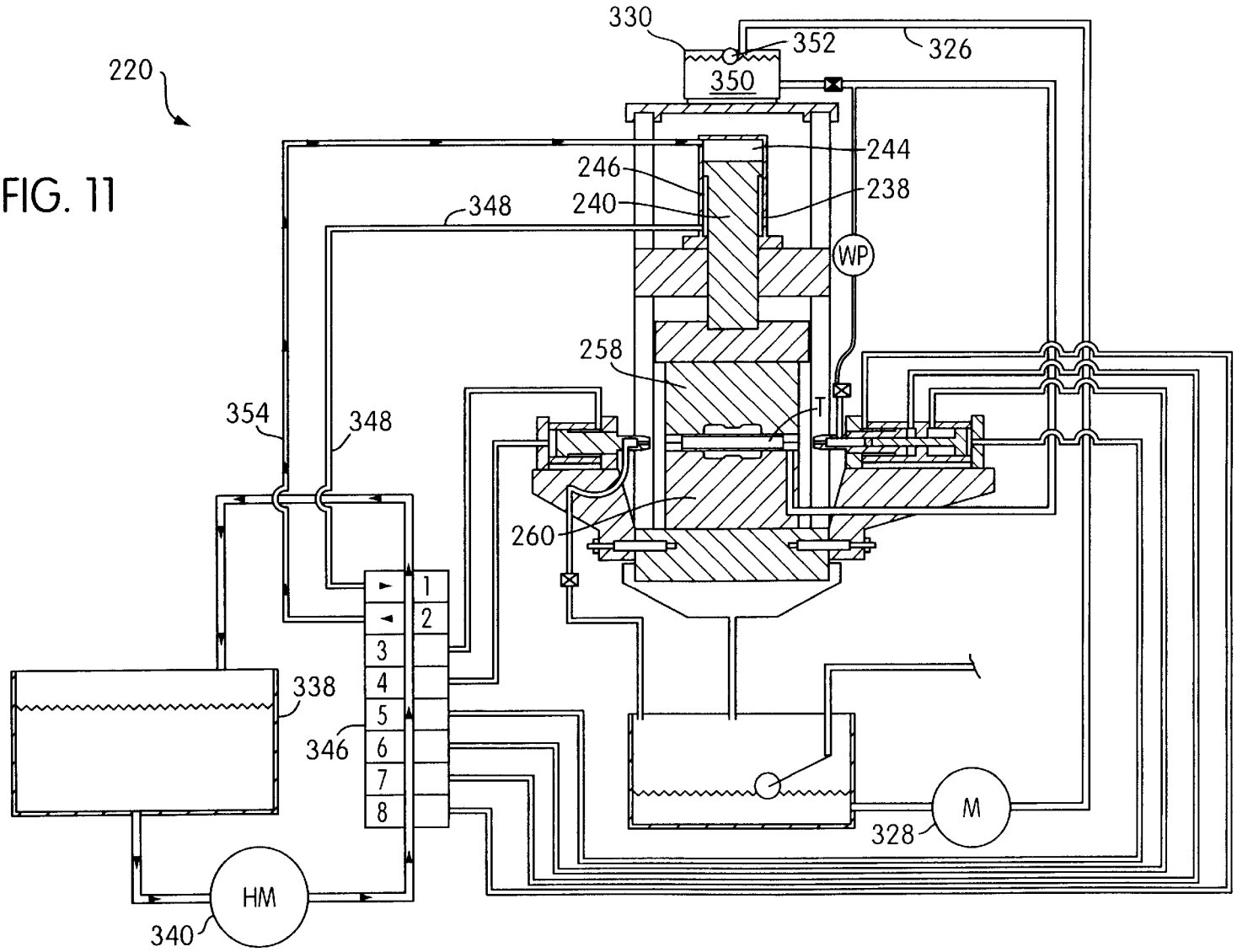
FIG. 11 is a schematic view similar to that shown in FIG. 10, but showing the press ram down and die closed.

In FIG. 11 it can be seen that the level of hydroforming fluid 350 in tank 330 has been increased in comparison with FIG. 10 as a result of fluid having been pumped through line 326. Eventually, the float valve 352 in the upper gravity feed tank 330 shuts off the water pump and motor 328 when the hydroforming fluid 350 has reached its proper level. The hydraulic valve No.1 of the control valve assembly 346 is a 3-way valve that closes to hydraulic fluid flow and opens to depressurize line 348. Also, opening valve No.1 prevents hydraulic back-pressure from building inside the chamber 246 during downward movement of the piston rod 240 by permitting trapped hydraulic fluid in chamber 246 to bleed back through line 348 and drain back to the hydraulic reservoir 338. Valve No. 2 opens to line 354 and enables pump 340 to pressurize the upper chamber 244 of the press ram cylinder 238. The press ram piston rod 240 moves downwardly and forces the upper die half 258 closed to clamp the tube blank T between die halves 258, 260. The hydraulic pressure in chamber 244 of the press ram cylinder 238 is maintained for the full hydroforming cycle until the tube blank T is fully deformed.

Figure 12:
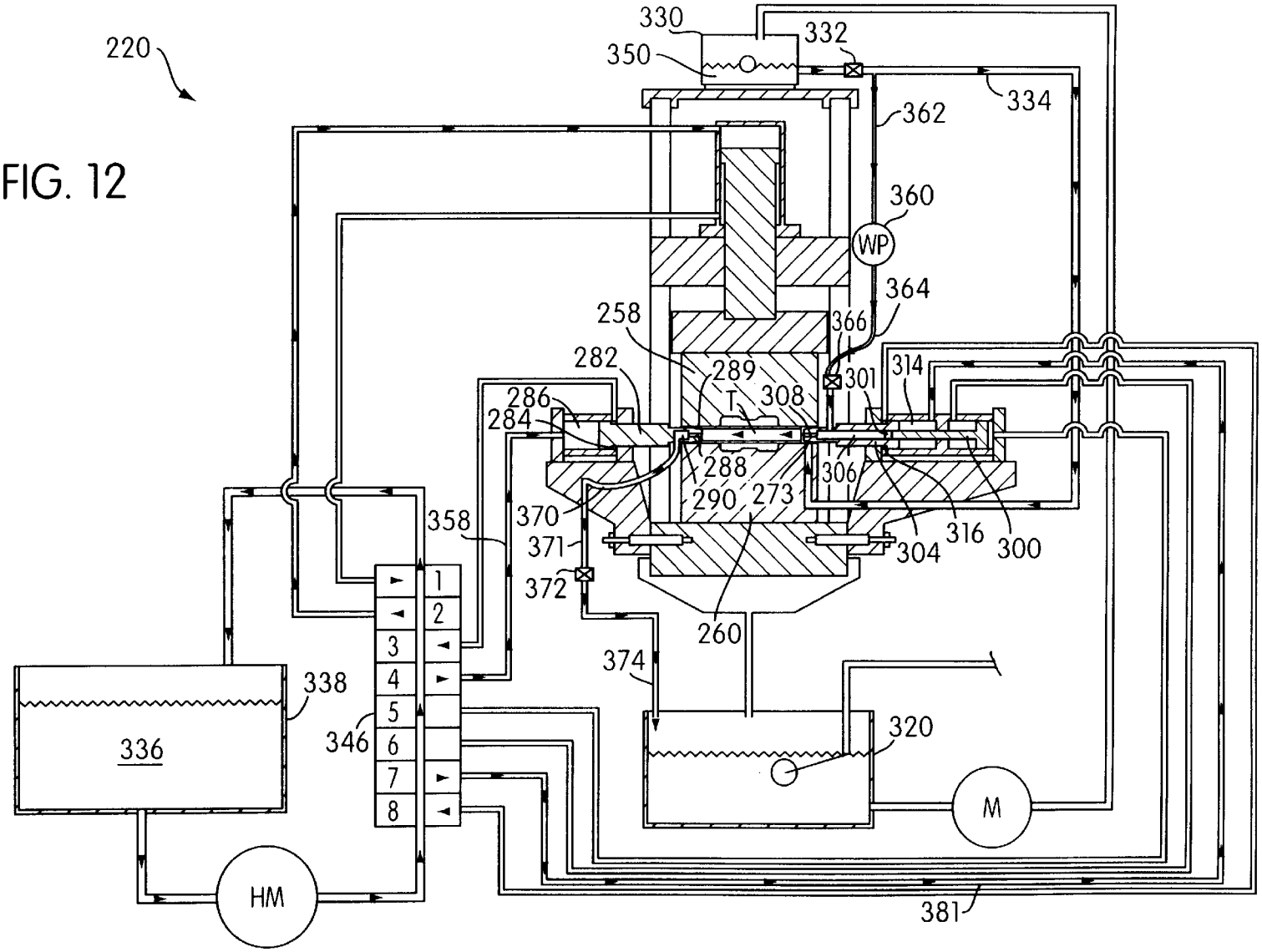
FIG. 12 is a schematic view similar to that shown in FIG. 11, but showing the side cylinders engaged and quick fill started.

In FIG. 12, the ram tube-end engaging structure 304 is activated by the opening of valve No. 7 to thereby allow hydraulic fluid to pass inwardly through line 381 and pressurize the tube-end engaging pressure chamber 314. This moves the tube-end engaging structure 304 toward one end of the tube blank T inside the closed die halves 258 and 260 to seal off the end of the closed die assembly while remaining spaced from the end of the tube blank T. On the opposing side of the hydroforming system, the tube-end engaging structure 282 is activated by opening valve No.4 to allow hydraulic fluid to flow through line 358 and into the pressurizing chamber 286. This forces the tube-end engaging structure 282 inwardly into the closed die halves 258 and 260 toward the opposite end of tube blank T. The tube-end engaging structure 282 moves forward to engage the inside diameter of the tube blank T with the tapered nose section 288 thereof and seal the adjacent end of the tube blank T. At the top of the system, a valve 332 is opened and allows the hydroforming fluid 350 to flow quickly through line 334 under gravitational force from the gravity tank 330. The hydroforming fluid enters the closed die through an inlet 273 and floods the interior of the tube blank T internally. Subsequently, the tube-end engaging structure 304 moves inwardly and the tapered nose portion 307 engages the tube blank T to seal the hollow interior thereof.

The water pump and motor 360 draws hydroforming fluid from the upper gravity tank 330 through line 362 and pumps it through a flex line 364 and a high pressure close-out valve 366. The hydroforming fluid travels into the intensifier chamber 306 from the close-out valve 366. It should be appreciated that in another preferred embodiment, pump and motor 360 is omitted, and hydroforming fluid travels from tank 330 to chamber 306 under force of gravity. The fluid is forced under low pressure from chamber 306 into the tube T through the fluid outlet 308 in the nose of the tube-end engaging structure 304. The high pressure seal 301 prevents the hydroforming fluid 350 from tank 330 from mixing with the hydraulic fluid 336 from tank 338. The hydroforming fluid that is forced through the fluid outlet 308, increases the pressure inside the tube blank T. This, in turn, evacuates or purges the air together with fluid carrying air bubbles inside the tube blank T through opening 289 of tube-end engaging structure 282. This mixture of fluid and air flows through the internal chamber 290 and into flexible high pressure hose connection sections 370 and 371. The hydroforming fluid then passes through a high pressure close-out valve 372 and into the lower hydroforming fluid reservoir 320 via line 374. Valve Nos. 3 and 8 of the control valve assembly 346 open to prevent any hydraulic back pressure building inside chambers 316 and 284 of the right and left lateral push cylinders, respectively.

Figure 13:
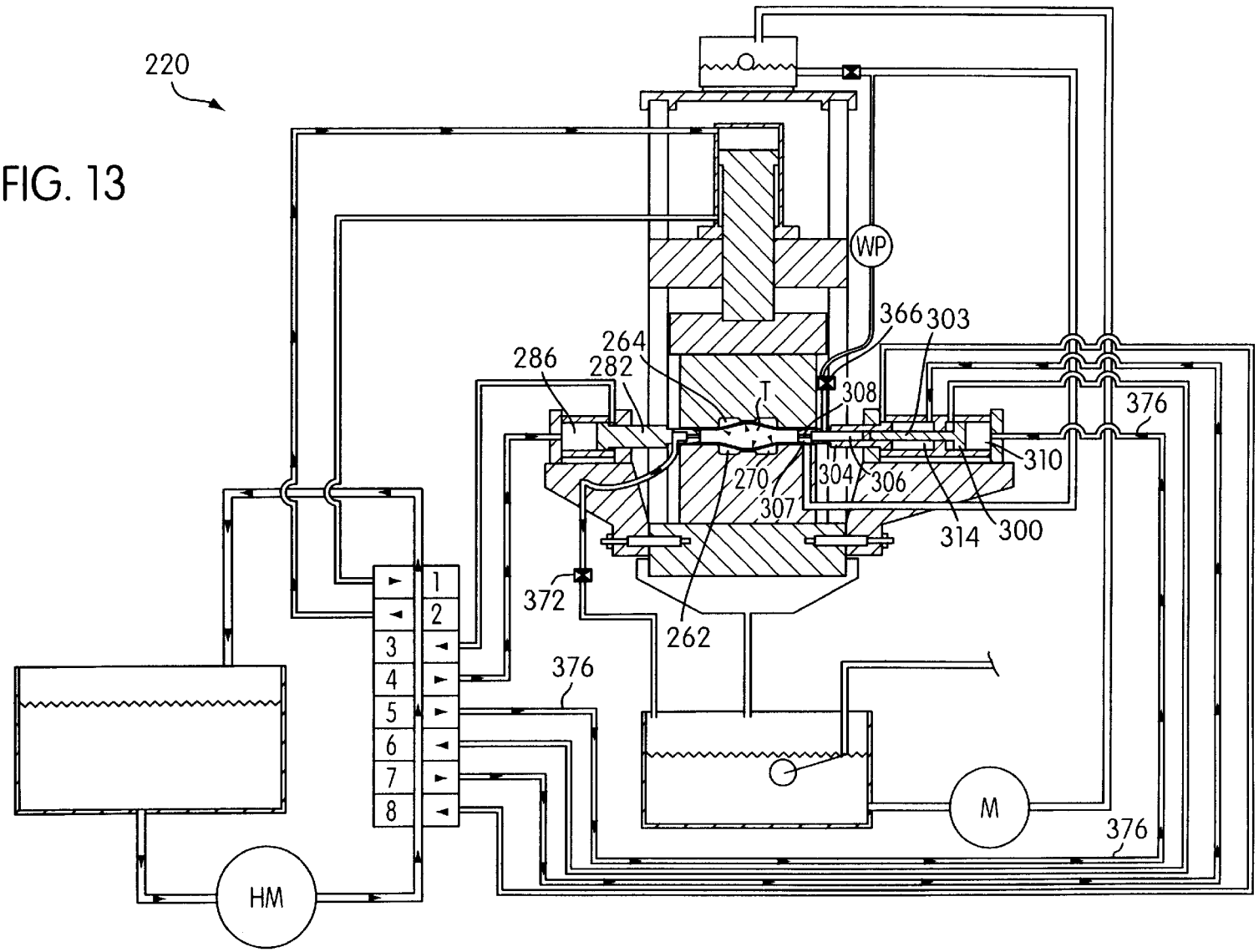
FIG. 13 is a schematic view similar to that shown in FIG. 12, but showing the side cylinders pushing inwardly on the tubular blank ends as fluid is being pressurized.

In FIG. 13, the high pressure close-out valves 366 and 372 are closed after the air has been evacuated from the inside of the tube blank T. Valve No. 5 opens allowing high pressure hydraulic fluid to travel through line 376 into the intensifier chamber 310. This forces the intensifier piston rod 300 to extend into the intensifier chamber 306, compressing the hydroforming fluid through the opening 308 in the tube-end engaging lateral piston rod 304 and inside the tube blank T. With the high pressure close-out valves 366 and 372 closed, the hydroforming fluid pressure is increased and begins forcing the walls of the tube blank T outwardly toward the die cavity surfaces 264 and 270. Valve No. 7 again opens to supply pressure to the chamber 314 to forwardly force tube-end engaging piston rod 304. This forces tube blank material T into the die cavity 262. The opposing tube-end engaging structure 282 moves forward when valve No. 4 again supplies pressure to chamber 286 and forces the tube-end engaging structure 282 to push tube blank material T into the die cavity 262. Forcing the ends of tube blank T into the die cavity 262 creates flow of metal material inwardly so as to maintain the wall thickness of the tube as it is expanded. The wall thickness of the final part is preferably to remain within ±10% of the wall thickness of the original blank.

As can also be appreciated in FIG. 13, the opposing piston rods 304 and 282 continue to force tube blank material into the die cavity 262 while the forward portion 303 of intensifier piston rod 300 extends further into the intensifier chamber 306. This increases the pressure inside the intensifier chamber 306, forcing more hydroforming fluid inside the tube blank T through the opening 308 in the forward nose portion 307 of the main piston rod 304. The hydroforming fluid within the tube blank T reaches pressures of greater than 50,000 psi.

Figure 14:
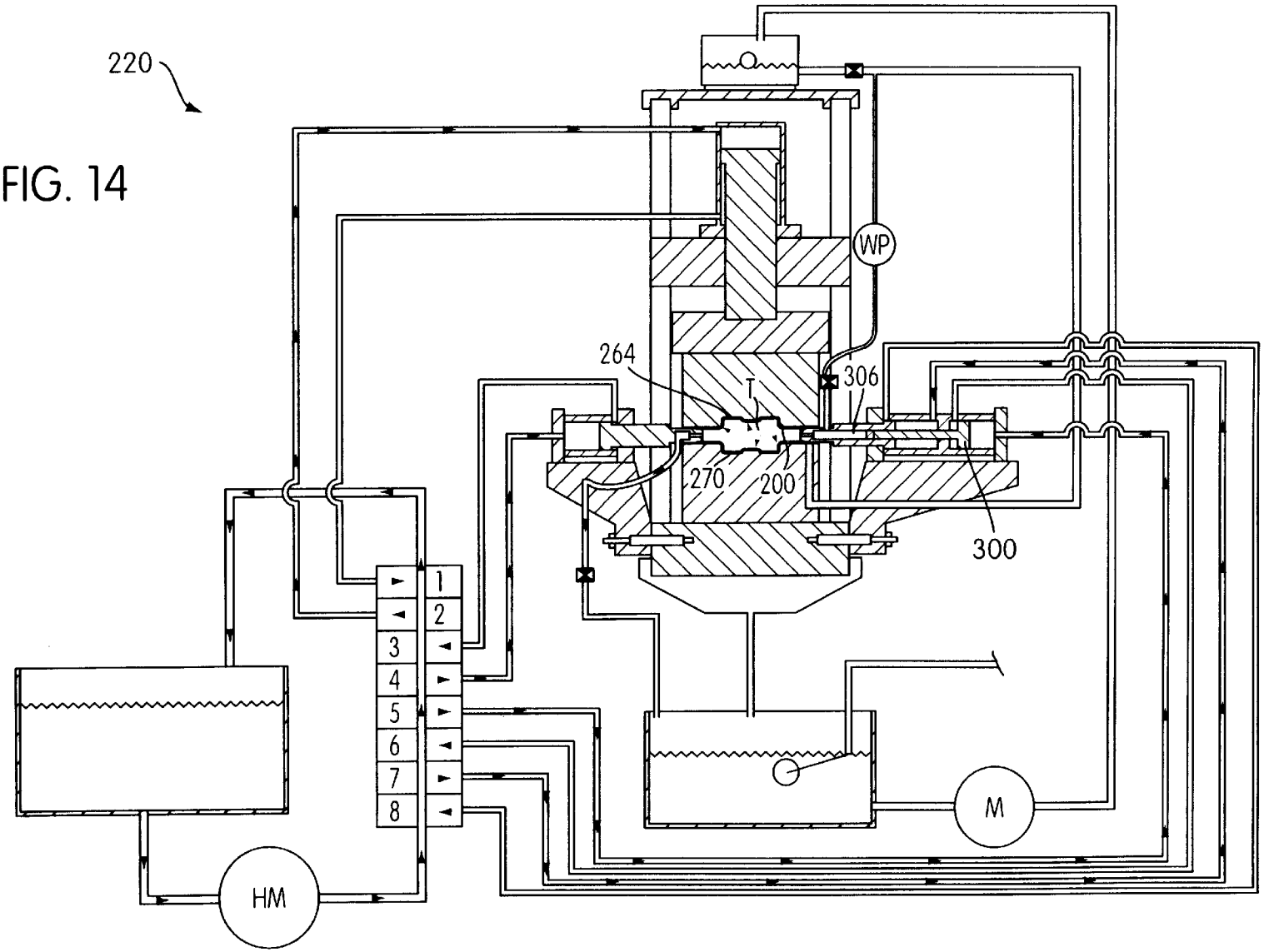
FIG. 14 is a schematic view similar to that shown in FIG. 13, but showing an expanded hydroformed tube.

Referring to FIG. 14, the intensifier piston rod 300 continues to move forward until the tube blank T is completely formed against the cavity surfaces 264 and 270 of the hydroforming die cavity through a preset pressure. The lateral push on the ends of the tube blank T is maintained until the final shape of the desired part 200 has been achieved. FIG. 14 shows the intensifier chamber 306 reaching its preset pressure, meaning that the hydroforming cycle is complete.

Figure 15:
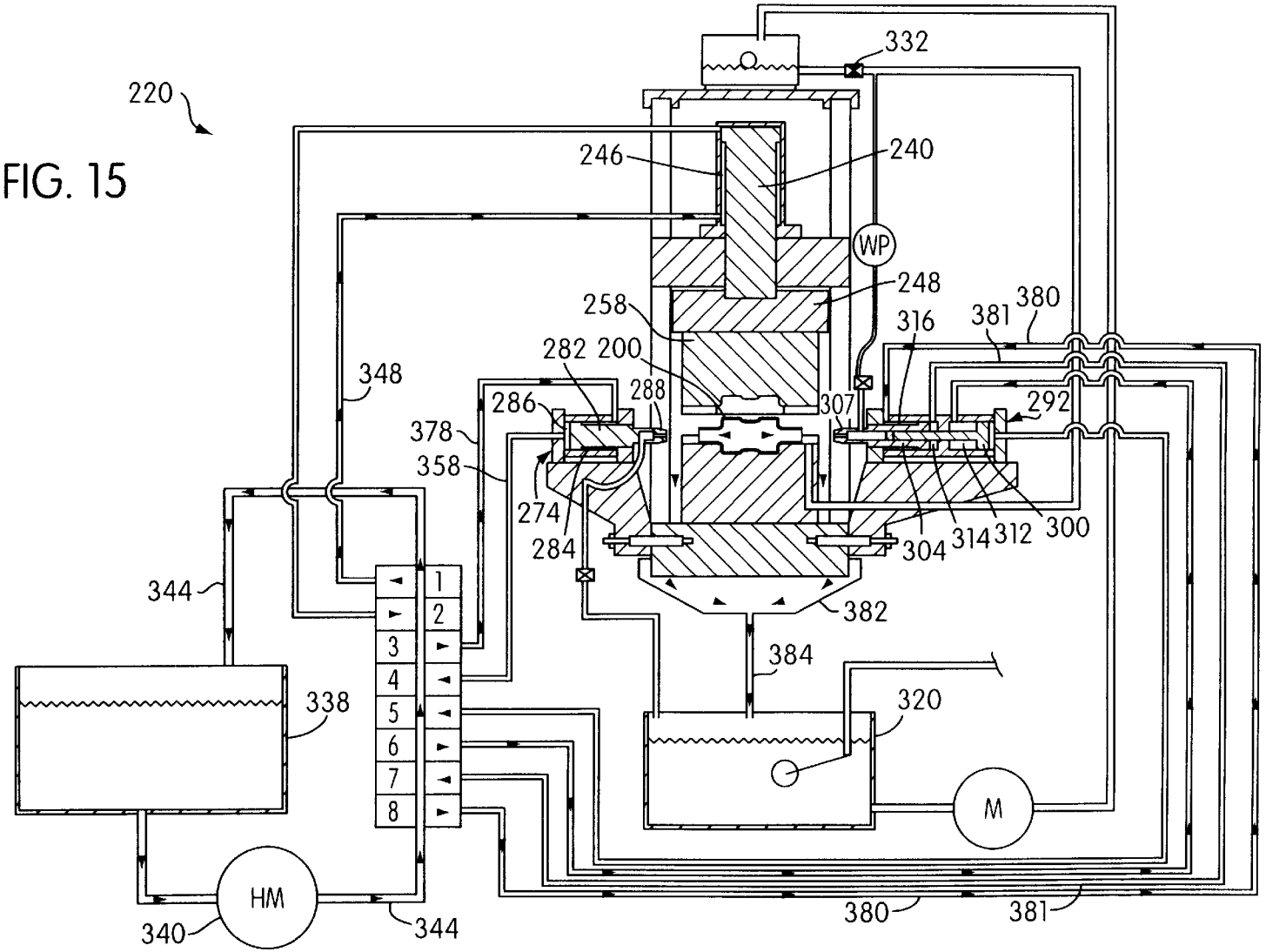
FIG. 15 is a schematic view similar to that shown in FIG. 14, but showing the press ram up after completion of the hydroforming cycle.

In FIG. 15, the intensifier piston rod 300 is retracted by the closing of valve No. 5 and the opening of valve No. 6 which forces hydraulic fluid into forward intensifier chamber 312, removing the extreme high pressure from the hydroforming fluid within the tube part. The lateral opposing tube-end engaging structure 282 retracts when valve No. 3 opens, permitting pump 340 to pressurize line 378 and chamber 284 of the push cylinder 274. This causes the tapered nose section 288 of the tube-end engaging structure 282 to move out of the end of the tube blank T. Three-way valve No. 4 is opened to depressurize line 358 and chamber 286 during retraction of tube-end engaging structure 282, so as to permit hydraulic fluid from chamber 286 to drain through line 344 into tank 338. Corresponding events occur at the opposite end of the tube blank T when valve No. 8 opens and pressurizes line 380 and chamber 316 of the cylinder 292. This causes the piston rod 304 to retract and remove the tapered surface 307 of the forward end of the piston rod 304 from the end of the tube blank T. The hydroforming fluid then drains from the tube blank T out of the die and into a press bed catch tray 382 where it is returned to the lower reservoir tank 320 through the drain line 374. Three-way valve No. 7 is opened to permit chamber 314 and line 381 to depressurize and drain through line 344 into tank 338 during retraction of piston 304. Valve No.1 is activated to connect pump 340 with chamber 246 along line 348. Chamber 246 is pressurized to retract the press ram cylinder rod 240. This raises the press ram 248 and opens the die upper half 258, allowing the finished part 200 (hydroformed from the tube blank T) to be removed. The gravity feed valve 332 closes, allowing hydroforming fluid to be pumped back into the upper gravity feed tank 330 to start the next hydroforming cycle.

Figure 16:
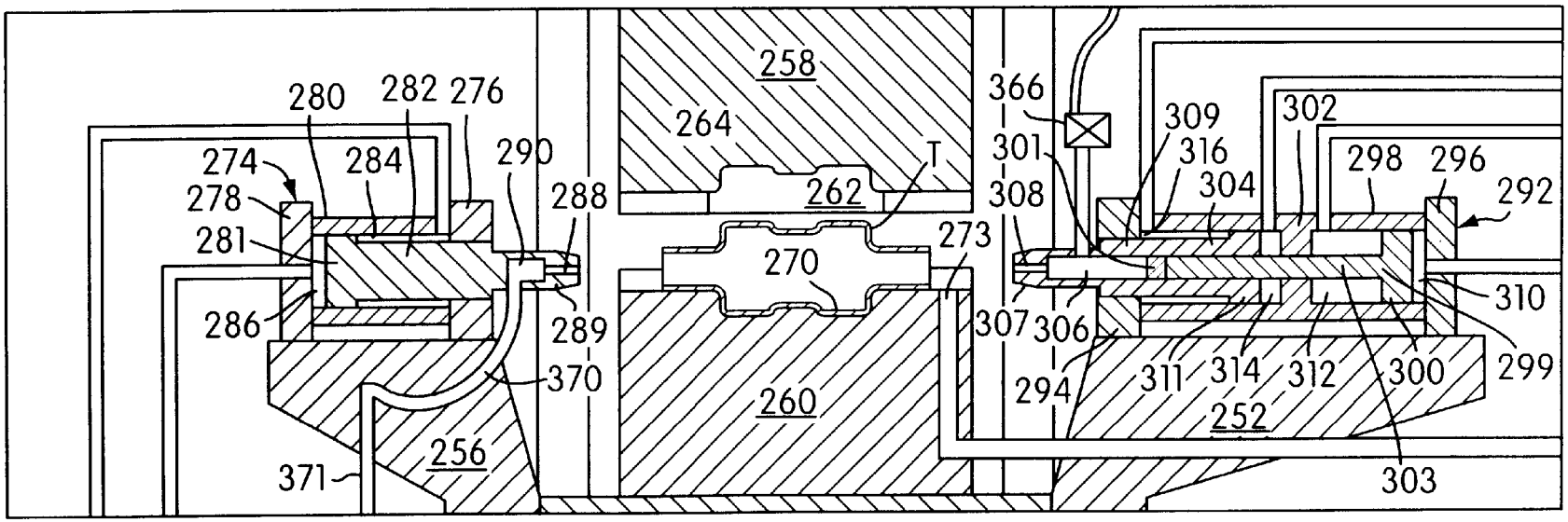
FIG. 16 is an enlarged longitudinal sectional view generally depicting the die halves and laterally disposed cylinders depicted in FIG. 15.

FIG. 16 provides an enlarged longitudinal sectional view depicting the hydroforming operational stage illustrated in FIG. 15, and more clearly shows the parts of the die assembly 228. In FIGS. 15 and 16, the part 200 has been formed and the die has been opened.

It should be appreciated that the present invention contemplates that the tube-end engaging structure may comprise only a single tube-end forcing component, with the opposing tube-end engaging component being a fixed component. This is in contrast to the previously-described embodiments, where the tube-end engaging structures comprise two moveable components that move toward one another.

Similarly, the pressure intensifying structure may provide high pressure fluid from only one end or from both ends of the tube part.

The above-described invention reduces the initial cost to purchase the hydroforming equipment by as much as one-third. It also reduces operating and maintenance costs.

While the invention has been disclosed and described with reference to a limited number of embodiments, it will be apparent that variations and modifications may be made therein without departure from the spirit and scope of the invention. Therefore, the following claims are intended to cover all such modifications, variations, and equivalents thereof in accordance with the principles and advantages noted herein.

What is claimed is:

1. An apparatus for hydroforming a tubular metal blank comprising:

a die structure having an internal die surface defining a die cavity, said die cavity being constructed and arranged to receive the tubular metal blank;

a hydroforming fluid source;

a hydraulically driven tube-end engaging structure constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source and having a hydroforming fluid supplying outlet through which hydroforming fluid can be provided to an interior of the tubular metal blank;

a hydraulically driven pressure intensifying structure movable to pressurize said hydroforming fluid provided to the interior of the tubular metal blank and thereby expand a diameter of the blank until an exterior surface of the tubular metal blank generally conforms to that of said internal die surface; and a single hydraulic power source constructed and arranged to supply hydraulic fluid under pressure to said hydraulically driven pressure intensifying structure and said hydraulically driven tube-end engaging structure, said single hydraulic power source providing said hydraulic fluid under pressure to said hydraulically driven pressure intensifying structure in order to move said pressure intensifying structure and thereby pressurize said hydroforming fluid provided to the interior of the tubular metal blank and expand the diameter of the tubular metal blank so that its exterior surface conforms to that of said internal die surface, said single hydraulic power source providing said hydraulic fluid under pressure to said hydraulically driven tube-end engaging structure to enable said tube-end engaging structure to longitudinally compress the tubular metal blank and cause metal material of the diametrically expanded tubular blank to flow longitudinally in order to replenish a wall thickness of the diametrically expanded tubular metal blank and maintain the wall thickness thereof within a predetermined range, and a valve assembly communicating said hydroforming fluid source and said single hydraulic power source with said pressure intensifying structure and said tube-end engaging structure, said valve assembly constructed and arranged to direct hydraulic fluid to selectively i) move said tube-end engaging structure into compression with said opposite ends of said tubular metal blank and ii) move said pressure intensifying structure to pressurize hydroforming fluid within said tubular metal blank so as to expand said tubular metal blank while maintaining the wall thickness of said tubular metal blank within said predetermined range, said valve assembly being operatively connected with said single hydraulic power source such that movement of said tube-end engaging structure and movement of said pressure intensifying structure can be controlled independently of one another.

2. An apparatus according to claim 2 wherein said die structure comprises a movable upper die portion and a fixed lower die portion, said upper die portion being movable between a closed position to define said die cavity with said lower die portion and an open position to respectively permit the tubular metal blank to be disposed on and removed from said lower die portion, said single hydraulic power source providing said hydraulic fluid to said upper die portion in order to move said upper die portion between said closed and open positions thereof.

3. An apparatus according to claim 1 wherein said hydroforming fluid source is disposed higher than said tube-end engaging structure such that said hydroforming fluid is provided to said tube-end engaging structure under the force of gravity.

4. An apparatus according to claim 1, wherein said valve assembly being adjustable to direct said hydraulic fluid to move said tube-end engaging structure away from said opposite ends of the tubular metal blank and to move said pressure intensifying structure to depressurize said hydroforming fluid after said hydroforming operation.

5. An apparatus according to claim 1 wherein said predetermined range is ±10% of the wall thickness of an original tubular metal blank.

6. An apparatus for hydroforming a tubular metal blank comprising:

a die structure having an internal die surface defining a die cavity, said die cavity being constructed and arranged to receive the tubular metal blank;

a hydroforming fluid source;

a hydraulically driven tube-end engaging structure constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source and having a hydroforming fluid supplying outlet through which hydroforming fluid can be provided to an interior of the tubular metal blank;

a hydraulically driven pressure intensifying structure movable to pressurize said hydroforming fluid provided to the interior of the tubular metal blank and thereby expand a diameter of the blank until an exterior surface of the tubular metal blank generally conforms to that of said internal die surface; and a single hydraulic power source constructed and arranged to supply hydraulic fluid under pressure to said hydraulically driven pressure intensifying structure and said hydraulically driven tube-end engaging structure, said single hydraulic power source providing said hydraulic fluid under pressure to said hydraulically driven pressure intensifying structure in order to move said pressure intensifying structure and thereby pressurize said hydroforming fluid provided to the interior of the tubular metal blank and expand the diameter of the tubular metal blank so that its exterior surface conforms to that of said internal die surface, said single hydraulic power source providing said hydraulic fluid under pressure to said hydraulically driven tube-end engaging structure to enable said tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range, said hydraulically driven tube-end engaging structure comprising a pair of movable tube-end engaging members disposed on opposing sides of said die structure, wherein said tube-end engaging members each has a longitudinal bore formed therein, and said pressure intensifying structure comprising a pair of pressure intensifying members disposed on the opposing sides of said die structure, each of said pressure intensifying members being mounted within an associated one of said bores of said tube-end engaging structures, each of said pressure intensifying members defining a pressure intensifying chamber within the associated one of said bores, said pressure intensifying chambers constructed and arranged to be in fluid communication with the interior of the tubular metal blank in said die cavity through said fluid supporting outlets when said tube-end engaging members are engaged with the opposite ends of the tubular metal blank such that longitudinal, inward movement of said pressure intensifying members reduces a volume of each of said pressure intensifying chambers to thereby pressurize the hydroforming fluid provided to the interior of the tubular metal blank and expand the diameter of said tubular metal blank so that its exterior configuration conforms to that of said internal die surface.

7. An apparatus for hydroforming a tubular metal blank comprising:

a die structure having an internal die surface defining a die cavity, said die cavity being constructed and arranged to receive the tubular metal blank;

a hydroforming fluid source;

a hydraulically driven tube-end engaging structure constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source and having a hydroforming fluid supplying outlet through which hydroforming fluid can be provided to an interior of the tubular metal blank;

a hydraulically driven pressure intensifying structure movable to pressurize said hydroforming fluid provided to the interior of the tubular metal blank and thereby expand a diameter of the blank until an exterior surface of the tubular metal blank generally conforms to that of said internal die surface; and a single hydraulic power source constructed and arranged to supply hydraulic fluid under pressure to said hydraulically driven pressure intensifying structure and said hydraulically driven tube-end engaging structure, said single hydraulic power source providing said hydraulic fluid under pressure to said hydraulically driven pressure intensifying structure in order to move said pressure intensifying structure and thereby pressurize said hydroforming fluid provided to the interior of the tubular metal blank and expand the diameter of the tubular metal blank so that its exterior surface conforms to that of said internal die surface, said single hydraulic power source providing said hydraulic fluid under pressure to said hydraulically driven tube-end engaging structure to enable said tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range, wherein said tube-end engaging structure comprises a pair of tube-engaging members disposed on opposing sides of said die structure, one of said tube-end engaging members having a longitudinal bore formed therein, said single pressure intensifying structure comprising a single pressure intensifying member disposed on one of said opposing sides of said die structure, said single pressure intensifying member being mounted within said longitudinal bore of said one of said tube-end engaging members, said single pressure intensifying member defining a pressure intensifying chamber within said longitudinal bore of said one of said tube-end engaging members, said pressure intensifying chamber being in fluid communication with the interior of the tubular metal blank in said die cavity through a fluid supplying outlet of said one of said tube-end engaging members when said tube-end engaging members engage the opposite ends of the tubular metal blank such that longitudinal inward movement of said single pressure intensifying member reduces a volume of said pressure intensifying chamber, to thereby pressurize the hydroforming fluid provided to the interior of the tubular metal blank and expand the diameter of the tubular metal blank, so that its exterior configuration conforms to that of said internal die surface.

8. An apparatus for hydroforming a tubular metal blank comprising:

a die structure having an internal die surface defining a die cavity, said die cavity being constructed and arranged to receive the tubular metal blank;

a hydroforming fluid source;

a hydraulically driven tube-end engaging structure constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source and having a hydroforming fluid supplying outlet through which hydroforming fluid can be provided to an interior of the tubular metal blank;

a hydraulically driven pressure intensifying structure movable to pressurize said hydroforming fluid provided to the interior of the tubular metal blank and thereby expand a diameter of the blank until an exterior surface of the tubular metal blank generally conforms to that of said internal die surface; and a single hydraulic power source constructed and arranged to supply hydraulic fluid under pressure to said hydraulically driven pressure intensifying structure and said hydraulically driven tube-end engaging structure, said single hydraulic power source providing said hydraulic fluid under pressure to said hydraulically driven pressure intensifying structure in order to move said pressure intensifying structure and thereby pressurize said hydroforming fluid provided to the interior of the tubular metal blank and expand the diameter of the tubular metal blank so that its exterior surface conforms to that of said internal die surface, said single hydraulic power source providing said hydraulic fluid under pressure to said hydraulically driven tube-end engaging structure to enable said tube-end engaging structure to longitudinally compress the tubular metal blank and cause metal material of the diametrically expanded tubular blank to flow longitudinally in order to replenish a wall thickness of the diametrically expanded tubular metal blank and maintain the wall thickness thereof within a predetermined range, and wherein said tube-end engaging structure comprises a tube-end engaging tubular member having an internal cavity, and wherein said pressure intensifying structure comprises a movable member disposed within and movable with respect to said tube-end engaging tubular member.

9. An apparatus for hydroforming a tubular metal blank comprising:

a die structure having an internal die surface defining a die cavity, said die cavity being constructed and arranged to receive the tubular metal blank;

a hydroforming fluid source;

a hydraulically driven tube-end engaging structure constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source and having a hydroforming fluid supplying outlet through which hydroforming fluid can be provided to an interior of the tubular metal blank;

a hydraulically driven pressure intensifying structure movable to pressurize said hydroforming fluid provided to the interior of the tubular metal blank and thereby expand a diameter of the blank until an exterior surface of the tubular metal blank generally conforms to that of said internal die surface; and a single hydraulic power source constructed and arranged to supply hydraulic fluid under pressure to said hydraulically driven pressure intensifying structure and said hydraulically driven tube-end engaging structure, said single hydraulic power source providing said hydraulic fluid under pressure to said hydraulically driven pressure intensifying structure in order to move said pressure intensifying structure and thereby pressurize said hydroforming fluid provided to the interior of the tubular metal blank and expand the diameter of the tubular metal blank so that its exterior surface conforms to that of said internal die surface, said single hydraulic power source providing said hydraulic fluid under pressure to said hydraulically driven tube-end engaging structure to enable said tube-end engaging structure to longitudinally compress the tubular metal blank and cause metal material of the diametrically expanded tubular blank to flow longitudinally in order to replenish a wall thickness of the diametrically expanded tubular metal blank and maintain the wall thickness thereof within a predetermined range, and said hydraulically driven tube-end engaging structure comprising a pair of movable tube-end engaging members disposed on opposing sides of said die structure, and wherein at least one of said tube-end engaging members comprises an internal cavity, and wherein said pressure intensifying structure comprises a movable member disposed within said at least one of said tube-end engaging members.

10. An apparatus for hydroforming a tubular metal blank comprising:

a die structure having an internal die surface defining a die cavity, said die cavity being constructed and arranged to receive the tubular metal blank;

a hydroforming fluid source disposed higher than said die cavity, and constructed and arranged to provide hydroforming fluid internally to said tubular metal blank so as to fill the tubular metal blank under the force of gravity;

a hydraulically driven tube-end engaging structure, constructed and arranged to engage and substantially seal opposite ends of the tubular metal blank in said die cavity, said tube-end engaging structure being movable to longitudinally compress the tubular metal blank, said tube-end engaging structure constructed and arranged to receive hydroforming fluid from said hydroforming fluid source disposed higher than said cavity and having a hydroforming fluid supplying outlet through which hydroforming fluid can be provided to an interior of the tubular metal blank; and a hydraulically driven pressure intensifying structure movable in response to hydraulic fluid pressure to pressurize said hydroforming fluid provided to the interior of the tubular metal blank and thereby expand a diameter of the blank until an exterior surface of the tubular metal blank generally conforms to that of said internal die surface, said hydraulically driven tube-end engaging structure being movable in response to hydraulic fluid pressure to enable said tube-end engaging structure to longitudinally compress the tubular metal blank and cause metal material of the diametrically expanded tubular blank to flow longitudinally inwardly in order to replenish a wall thickness of the diametrically expanded tubular metal blank and maintain the wall thickness thereof within a predetermined range.

11. An apparatus according to claim 10 wherein said hydroforming fluid source provides said hydroforming fluid through a first path to fill said tubular metal blank prior to engagement of said tube-end engaging structure with the opposite ends of said tubular metal blank, and wherein said hydroforming fluid source provides said hydroforming fluid through a second path different from said first path to said tube-end engaging structure and through said fluid supplying outlet into said tubular metal blank after said tube-end engaging structure engages the opposite ends of said tubular metal blank.

12. An apparatus according to claim 11 wherein said hydroforming fluid is forced through said first path and through said second path under the force of gravity.

13. An apparatus according to claim 12 wherein said second path comprises a pump for facilitating flow of hydroforming fluid to said tube-end engaging structure.

* * * * *